US005772575A

United States Patent [19]

Lesinski et al.

[11] Patent Number: 5,772,575

[45] Date of Patent: Jun. 30, 1998

[54] IMPLANTABLE HEARING AID

[75] Inventors: S. George Lesinski, 629 Oak St., Suite 201, Cincinnati, Ohio 45206; Armand P. Neukermans, 3510 Arbutus Ave., Palo Alto, Calif. 94303

[73] Assignees: S. George Lesinski, Cincinnati, Ohio; Armand P. Neukermans, Palo Alto, Calif.

[21] Appl. No.: 532,398

[22] Filed: Sep. 22, 1995

[51] Int. Cl.[6] ..... H04R 25/00

[52] U.S. Cl. ..... 600/25

[58] Field of Search ..... 600/25; 607/55–57; 181/128–137; 381/68–68.3

[56] References Cited

U.S. PATENT DOCUMENTS

| | | | |
|---|---|---|---|
| Re. 31,031 | 9/1982 | Kissiah, Jr. | 179/107 R |
| 3,346,704 | 10/1967 | Mahoney | 179/107 |
| 3,557,775 | 1/1971 | Mahoney | 128/1 |
| 3,594,514 | 7/1971 | Wingrove | 179/107 R |
| 3,712,962 | 1/1973 | Epley | 179/107 R |
| 3,764,748 | 10/1973 | Branch et al. | 179/107 E |
| 3,870,832 | 3/1975 | Fredrickson | 179/107 E |
| 3,882,285 | 5/1975 | Nunley et al. | 179/107 E |

(List continued on next page.)

FOREIGN PATENT DOCUMENTS

| | | | |
|---|---|---|---|
| 0076069A1 | 4/1983 | European Pat. Off. . | |
| 0 242 038 | 10/1987 | European Pat. Off. . | |
| 0259906A1 | 3/1988 | European Pat. Off. . | |
| 0 263 254 | 4/1988 | European Pat. Off. . | |
| 0563767 | 10/1993 | European Pat. Off. | 623/10 |
| 2688132 | 9/1993 | France | 623/10 |
| 28 25 233 | 1/1979 | Germany . | |
| 36 17 118 | 8/1989 | Germany . | |
| 39 18 086 | 9/1990 | Germany . | |
| 1551371 | 3/1990 | U.S.S.R. | 623/10 |
| 1440724 | 6/1976 | United Kingdom . | |
| 2176078 | 4/1986 | United Kingdom . | |
| 2188290 | 5/1986 | United Kingdom . | |
| 9000040 | 1/1990 | WIPO | 623/10 |
| 9007915 | 7/1990 | WIPO | 623/10 |
| WO94/17645 | 4/1994 | WIPO . | |

OTHER PUBLICATIONS

Hearing Aid, Arch Otolaryngol Head Neck Surg.—vol. 113, Aug. 1987.

"How I Do It"–Otology and Neurotology, Laryngoscope 93: Jun. 1983, pp. 824–825.

Lasers in Revision Stapes Surgery, S. George Lesinski, M.D., Janet A. Stein, Head and Neck Surgery, vol. 3, No. 1 (Mar.) 1992, pp. 21–31.

Lasers for Otosclerosis –Which One if Any and Why, S. George Lesinski, M.D. Lasers in Surgery and Medicine 10:448–457 (1990).

(List continued on next page.)

*Primary Examiner*—John P. Lacyk

[57] ABSTRACT

A hearing aid includes an implantable microphone, signal-processing amplifier, battery, and microactuator. An electrical signal from the microphone is amplified and processed by the amplifier before being applied to the microactuator. The microactuator is adapted for implantation in a subject at a location from which it may mechanically create vibrations in the perilymph fluid within a subject's inner ear. A transducer of the microactuator is preferably a thin circular disk, 2 to 8 mils thick, of stress-biased PLZT. Disks of this stress-biased PLZT material can be mounted as drumheads in various different ways, preferably in conjunction with a flexible diaphragm, to small threaded metal tubes, e.g. 1.4 mm in diameter and 2.0 mm long. These tubes may be implanted into a fenestration formed through the promontory adjacent to the oval window of a subject's inner ear. Securing the disk to a tube having a larger diameter than that implanted into the fenestration and filling the tube with fluid provides hydraulic amplification of the transducer's displacement. The implantable microphone is preferably fabricated from a thin sheet of PVDF that is overcoated with inert metal electrodes.

57 Claims, 11 Drawing Sheets

U.S. PATENT DOCUMENTS

| | | | |
|---|---|---|---|
| 4,063,048 | 12/1977 | Kissiah | 179/107 R |
| 4,078,160 | 3/1978 | Bost . | |
| 4,284,856 | 8/1981 | Hochmair et al. | 179/107 E |
| 4,367,426 | 1/1983 | Kumada et al. . | |
| 4,383,196 | 5/1983 | Perduijn et al. . | |
| 4,419,495 | 12/1983 | Hochmair et al. . | |
| 4,419,995 | 12/1983 | Hochmair et al. | 128/419 |
| 4,498,461 | 2/1985 | Hakansson | 128/1 R |
| 4,606,329 | 8/1986 | Hough . | |
| 4,617,913 | 10/1986 | Eddington | 128/1 R |
| 4,726,099 | 2/1988 | Card et al. . | |
| 4,729,366 | 3/1988 | Schaefer | 128/1.6 |
| 4,756,312 | 7/1988 | Epley . | |
| 4,817,607 | 4/1989 | Tatge | 128/419 R |
| 4,817,609 | 4/1989 | Perkins et al. . | |
| 4,850,962 | 7/1989 | Schaefer | 600/25 |
| 4,908,509 | 3/1990 | Senturia | 356/373 |
| 4,928,264 | 5/1990 | Kahn | 367/141 |
| 4,932,405 | 6/1990 | Peters et al. . | |
| 4,943,750 | 7/1990 | Howe et al. | 310/309 |
| 4,957,478 | 9/1990 | Maniglia | 600/25 |
| 4,985,926 | 1/1991 | Foster . | |
| 4,988,333 | 1/1991 | Engebretson et al. | 625/25 |
| 4,999,819 | 3/1991 | Newnham et al. . | |
| 5,015,224 | 5/1991 | Maniglia . | |
| 5,015,225 | 5/1991 | Hough et al. | 600/25 |
| 5,033,999 | 7/1991 | Mersky | 600/25 |
| 5,061,282 | 10/1991 | Jacobs | 623/10 |
| 5,070,535 | 12/1991 | Hochmair | 455/41 |
| 5,085,628 | 2/1992 | Engebretson et al. | 600/25 |
| 5,091,820 | 2/1992 | Iwaya et al. . | |
| 5,095,904 | 3/1992 | Seligman et al. | 128/420.6 |
| 5,176,620 | 1/1993 | Gilman | 600/25 |
| 5,180,319 | 1/1993 | Beoni | 623/10 |
| 5,191,559 | 3/1993 | Kahn et al. . | |
| 5,271,397 | 12/1993 | Seilgman et al. | 607/137 |
| 5,276,657 | 1/1994 | Newnham et al. . | |
| 5,277,694 | 1/1994 | Leysieffer et al. | 600/25 |
| 5,282,858 | 2/1994 | Bisch et al. | 623/10 |
| 5,306,299 | 4/1994 | Applebaum | 623/10 |
| 5,318,502 | 6/1994 | Gilman | 600/25 |
| 5,338,287 | 8/1994 | Miller et al. . | |
| 5,344,387 | 9/1994 | Lupin . | |
| 5,376,857 | 12/1994 | Takeuchi et al. . | |
| 5,408,534 | 4/1995 | Lenzini et al. . | |
| 5,411,467 | 5/1995 | Hortmann et al. | 600/25 |
| 5,456,654 | 10/1995 | Ball . | |
| 5,471,721 | 12/1995 | Haertling . | |
| 5,498,226 | 3/1996 | Lenkauskas | 600/25 |
| 5,531,787 | 7/1996 | Lesinski et al. | 623/10 |
| 5,554,096 | 9/1996 | Ball . | |

OTHER PUBLICATIONS

Lasers for Ostoclerosis, S. George Lesinski, M.D., The Laryngoscope, Supplement No. 46, Jun. 1989, vol. 99, No. 6, Part 2, pp. 1–24.

Homograft (Allograft) Tympanoplasty Update, S. George Lesinski, M.D., Laryngoscope, vol. 96, No. 11, Nov. 1986.

Reconstruction of Hearing When Malleus Is Absent: Torp vs. Homograft TMMI, S. George Lesinski, M.D., Laryngoscope, vol. 94, No. 11, Nov. 1984.

Homograft Tympanoplasty in Perspective, A Long–Term Clynical–Histologic Study of Formalin–Fixed Tympanic Membranes Used for the Reconstruction of 125 Severely Damaged Middle Ears, S. George Lesinski, M.D., The Laryngoscope, Supplement No. 32—vol. 93, No. 11, Part 2, Nov. 1983, pp. 1–37.

Microfabrication Techniques for Integrated Sensors and Microsystems, K. D. Wise, et al., Science, vol. 254, Nov. 1991, pp. 1335–1341.

Hearing Aids: A Historical and Technical Review, W. F. Carver, Ph.D., Jack Katz, Ph.D., Handbook of Clinical Audiology, 1972, pp. 564–576.

Implantable Hearing Devices–State of the Art. Anthony J. Maniglia, M.D., Otolaryngologic Clinics of North America, vol. 22, No. 1, Feb. 1989, pp. 175–200.

Current Status of Electromagnetic Implantable Hearing Aids, Richard L. Goode, M.D., Otolaryngologic Clinics of North America, vol. 22, No. 1, Feb. 1989, pp. 201–209.

History of Implantable Hearing Aid Development: Review and Analysis, John M. Epley, edited by I. Kaufman Arenberg, Kugler Publications 1991.

Proceeding of the Third International Symposium and Workshops on the Surgury of the Inner Ear, Snomass, CO, USA, Jul. 29–Aug. 4, 1990.

FIG._2a
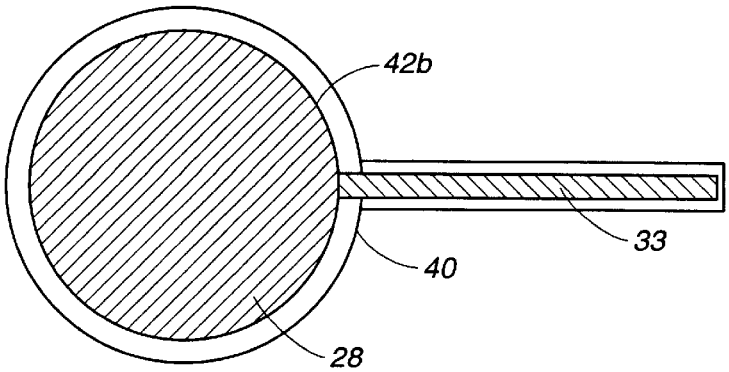
FIG._2b
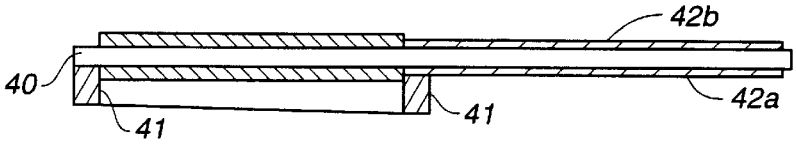
FIG._2c
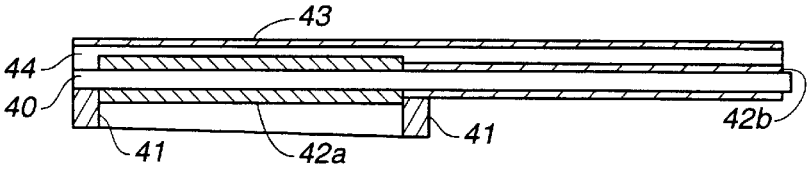
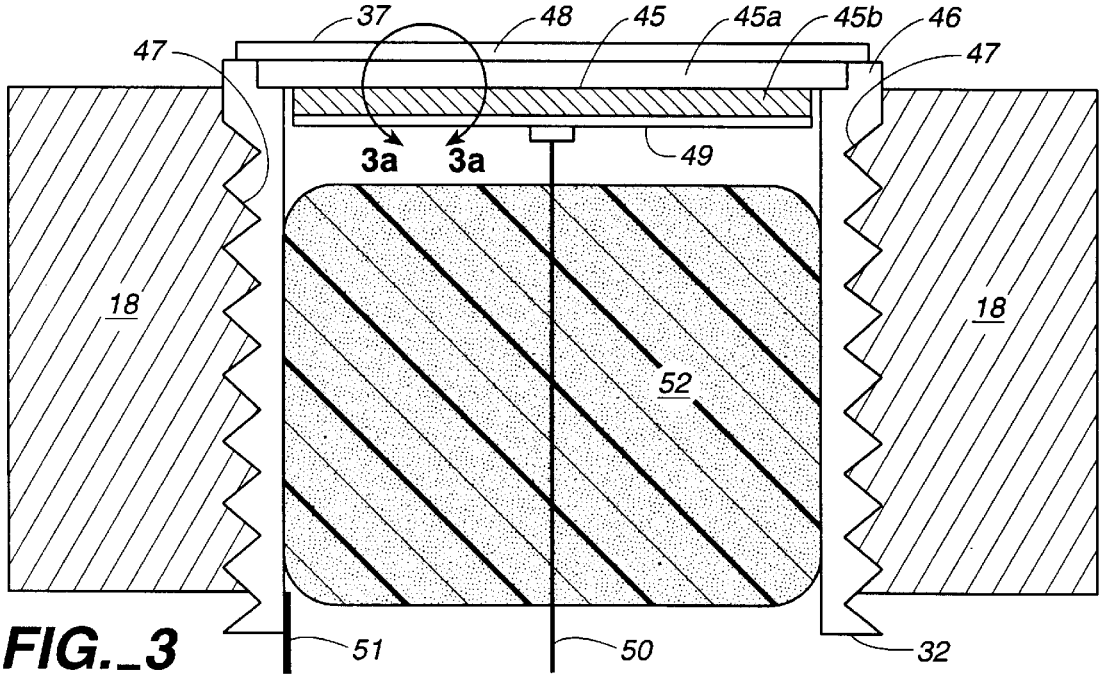
FIG._3
FIG._3a
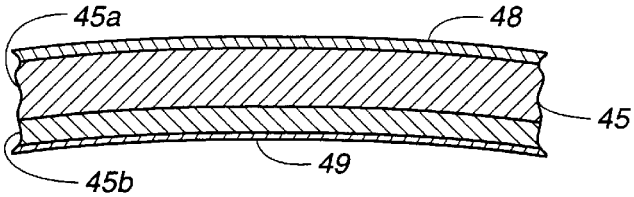

IMPLANTABLE HEARING AID

BACKGROUND OF THE INVENTION

1. Field of the Invention

The present invention relates generally to hearing aids and, more particularly, to hearing aids adapted for implantation into a human subject.

2. Description of the Prior Art

In normal human hearing, acoustical energy in the form of sound waves is directed into the ear canal of a human by an outer ear. The sound waves impinge upon a tympanic membrane, i.e. the eardrum, located at the inner end of an outer ear canal. The pressure of the sound waves causes tympanic vibrations in the eardrum, thereby producing mechanical energy.

Three interconnected bones, referred to as the ossicular chain, transfer these tympanic vibrations of the eardrum across a middle ear cavity and into an inner ear. The ossicular chain includes three major bones, the malleus, the incus and the stapes. The stapes resides in the oval window, attached to its margins by the annular ligament. The oval window serves as the entrance to the inner ear.

Mechanical vibrations conducted to the oval window generate vibrations within the inner ear fluids, the perilymph and then the endolymph. The hearing portion of the inner ear is a hollow, spiral otic capsule bone shaped like a snail shell and called the cochlea. The cochlea is divided into three chambers, the scala vestibuli, scala tympani which contain perilymph, and the scala media which contains endolymph. Sound vibration (pressure waves) enter the perilymph of scala vestibuli and are transmitted to scala media across a thin elastic membrane (Reisner's membrane). The floor of scala media is the basilar membrane, a flexible membrane which has an elasticity gradient progressing from stiff to flexible. The varying resonant characteristics of the basilar membrane permit pitch differentiation with the basal coil of the cochlea being sensitive to high frequencies and the apical to low frequencies. Positioned on the basilar membrane are 16,000 receptor cells ("hair cells") arranged in three rows of outer hair cells, and one row of inner hair cells. The cilia of these hair cells insert into a rigid tectorial membrane. As the basilar membrane is displaced upward the cilia bend, the shearing effect produces a change in membrane permeability of the hair cells and potassium contained in the potassium rich endolymph invades the hair cells, depolarizing the cell. The bases of the hair cells are innervated by auditory nerve fibers which are activated by this depolarization. The auditory nerve fibers then transmit signals ultimately to the temporal lobe of the brain where the subject consciously perceives sound.

Generally, hearing difficulties fall into one of two categories. Conductive hearing loss relates to the inability, or inefficiency, in mechanically conveying the vibrations caused by sound waves through the outer ear, the middle ear and the oval window to the perilymph. Sensorineural hearing impairment relates to deterioration of the receptor cells or nerve fibers within the inner ear, so that fluid vibrations within the inner ear are not properly converted to nerve impulses and thus inadequately transmitted to the brain.

Over the years, various devices or aids have been developed to improve the hearing of hearing-impaired individuals. One such device is generally referred to as an externally worn hearing aid. This device receives, processes and then amplifies soundwaves that are supplied to the external ear canal. While it has been estimated that 20% of hearing-impaired individuals have purchased a hearing aid, it is also reported that less than one-half of these individuals wear their hearing aid regularly, and 60% are dissatisfied with the performance of their hearing aid.

Present hearing aids, which have been in development since the earliest transistor amplifiers, still exhibit substantial shortcomings, in spite of a development period which spans almost 40 years. External hearing aids suffer from social stigma, and generally the sound quality is poor. While in-the-ear hearing aids are more cosmetically acceptable, individuals often find them uncomfortable. The plugging of the outer ear results in autophony (hearing one's own voice in that ear), and recurrent external ear infections. Besides such imperfections in hearing aid technology, the environment in which a hearing aid operates imposes physical limitations that constrain results achievable with current devices. For example, producing sound in a small cavity, such as the ear canal when obstructed by a hearing aid, causes constructive and destructive acoustical wave interference. This interference results in enhancement at some frequencies, diminution at other frequencies, and distortion of the remaining acoustical waves. Furthermore, the proximity of the microphone and speaker in present hearing aids creates positive feedback, which produces whistling and screeching if the hearing aid's volume is turned up too high, and substantial distortion in sound at other times. Moreover, even if feedback did not interfere with the sound reproduction by present hearing aids, they generally possess sound reproduction quality which is vastly inferior to even an inexpensive hi-fi system. Finally, conventional hearing aids provide only limited amplification, e.g. 30–70 decibels ("dB") because at high amplitudes the hearing aid speaker vibrates the hearing aid's casing which excites the hearing aid's microphone thereby recycling the vibration as "feedback."

In addition to the problems inherent in present hearing aids, there exist circumstances in which they cannot be used at all. For example, some individuals' hearing is impaired by conditions which prevent wearing an external hearing aid, e.g. chronic external ear skin canal conditions such as eczema, psoriasis or chronic infections, congenitally absent external ear or middle ear, perforated ear drum, chronic middle ear infections, etc. Alternatively, even for individuals who can wear an external hearing aid, there exists times during which such a device may not be worn, e.g. playing contact sports, swimming, showering, etc.

In an effort to address the limitations inherent in external hearing aids, a number of semi-implantable hearing devices have been developed. Such semi-implantable hearing aids actuate the inner ear either electromagnetically, or by a piezoelectric bimorph lever.

For example, numerous schemes propose implanting permanent magnets on a subject, which are then to be driven by a magnetic field produced by a coil. The forces thus applied to the permanent magnet are then coupled to the middle ear to stimulate inner ear fluids with sound waves and thus permit the individual to perceive sound. Such semi-implantable electromagnetic hearing aids have not been commercially successful for two reasons:

1. the electric current required to create a magnet field in such electromagnetic devices drains the device's batteries in a few hours; and
2. they are only semi-implantable because they require both a bulky external induction coil, and battery replacement or recharging every 12–24 hours A commercially practical implantable hearing aid should have a battery life of five or more years before replacement.

Semi-implantable hearing aids using a piezoelectric bimorph envision excitation of the ossicular chain. The piezoelectric bimorphs also have two major limitations:

1. excessive length of the bimorph; and
2. excessive current requirement with correspondingly short battery life Unfortunately the middle ear is too small to accommodate a piezoelectric bimorph having a lever of sufficient length to produce adequate amplitude of vibrations to amplify the motions of the ossicular chain. Bimorphs are presently being used in Japan. However, to accommodate the excessive length, a radical mastoidectomy is required and the bimorph is inertially anchored in the mastoid. This requires a major destructive otologic procedure and in some cases closure of the external ear canal. To the extent that implanting such a device requires performing destructive procedures on a subject, making the subject's existing hearing worse, these devices are not likely to be approved in the United States by the Food and Drug Administration ("FDA"). The excessive current requirement of piezoelectric semi-implantable devices also requires an external microphone, battery pack, and signal processor.

Patent Cooperation Treaty ("PCT") patent application WO 74/17645 by George S. Lesinski and Thurman H. Henderson, published 4 August 1994 ("the Lesinski et al. patent application"), describes a fully implantable hearing aid and proposes a microactuator, preferably implanted into the promontory of the bony otic capsule or onto the footplate of the stapes bone, to stimulate the perilymph. In the hearing aid described in the Lesinski et al. patent application, sound impinges upon an implanted microphone or micro-accelerometer. The electrical signal thus generated is then amplified and applied to drive an implanted, electrostatic, micro-machined transducer. However, experiments have shown that such electrostatic actuators, besides being very fragile, produce displacements that result in insufficiently large vibrations in the perilymph. The Lesinski et al. patent application is hereby incorporated by reference as though fully set forth here.

For frequencies up to 1000 Hertz ("Hz"), laser interferometry measurements on the human middle ear made by Goode, American Journal of Otology, vol. 14, no. 2, March 1994, and several other investigators establish that the displacement of the stapes for a sound level of 100 dB is about 0.10 micron peak-to-peak ("PTP"). At higher frequencies, the displacement drops off very rapidly at roughly 13 dB per octave. The effective area of the stapes bone is 3.4 square-millimeters ("$mm^2$"). To replicate a 100 dB sound level by directly stimulating the perilymph, a transducer must generate a volumetric displacement equal to that produced by the stapes, approximately $1.7\times10^{-4}$ microliters. If a microactuator is to be implanted into a fenestration through the promontory of the cochlea (inner ear), the transducer's diameter is limited to 1.2 mm by the anatomic dimensions of the scala vestibuli in the basal coil of the cochlea adjacent to the promontory. Generating a 100 dB sound level using only a microactuator having a diameter of 1.2 mm requires a 0.3 micron PTP displacement of its transducer. However, in most instances of hearing impairment, the subject's middle ear and the stapes bone function normally. Under such circumstances, an implanted microactuator serves as a "booster amplifier" supplementing the normal volumetric displacement of the perilymph by the stapes. To generate normal speech levels of 60 dB, a 0.003 micron PTP displacement of the perilymph by such a microactuator is all that is needed.

Surgical fenestration of the promontory has been accomplished without damage to the inner ear by Jahrsdorfer (Houston, Tx.), Causse and Vincent (Beziers, France), Fisch (Zurich, Switzerland), and Plester (Germany) utilizing mechanical drills or surgical lasers. Hearing has been successfully restored in these subjects by transmitting sound vibrations into the perilymph of the scala vestibuli through a passive mechanical prosthesis attached to the malleus or incus and inserted into the fenestration. Over the past 30 years, fenestration of the oval window by removal of the stapes bone (stapedectomy) or by creating a hole in the fixed stapes footplate (stapedotomy) has been routinely performed by ear surgeons for transmission of sound into the inner ear utilizing a passive prosthesis attached to the incus or malleus.

An implantable microphone, in essence, must be a fluid filled hydrophone that is hermetically sealed since it contacts the tissues and fluids of the body. Furthermore, implantable microphones must be very rugged since they are preferably implanted subcutaneously in locations on the body which provide good sound reception. However, such locations are also subject to accidental application of external blows or high pressure.

SUMMARY OF THE INVENTION

An object of the present invention is to provide a fully implantable hearing aid which overcomes problems associated with presently available commercial external hearing aids, and also the problems associated with the semi-implantable electromagnetic and piezoelectric devices.

Another object of the present invention is to provide an implantable hearing aid which is sufficiently safe and reliable to receive FDA approval.

Another object of the present invention is to provide a microactuator for an implantable hearing aid that is small enough to eliminate any need for major and/or destructive surgical procedures.

Another object of the present invention is to provide an implantable hearing aid, and particularly a microactuator, that consumes little electric power.

Another object of the present invention is to provide an implantable hearing aid having a high probability of overcoming a subject's conductive and/or sensorineural hearing deficiency, but which does not cause an irreversible hearing loss by the subject if the device proves to be ineffective for the subject.

Another object of the present invention is to provide a transducer which generates vibrations in the perilymph, replacing or enhancing the action of the ossicular chain.

Yet another object of the present invention is to provide a microactuator adapted for implantation into a fenestration through the promontory or in the middle ear which requires an area for mechanically creating vibrations in the perilymph that is no larger than the effective area of the stapes footplate.

Yet another object of the present invention is to provide a microactuator adapted for implantation into a fenestration through the promontory or in the middle ear cavity which creates vibrations in the perilymph that are in phase with vibrations produced by the stapes, and that are of sufficient amplitude to produce adequate sound levels.

Yet another object of the present invention is to provide a microactuator adapted for implantation into a fenestration through the promontory or in the middle ear cavity which reproduces a sound level of 100 dB over a frequency range extending from 150 to 4,000 Hz.

Yet another object of the present invention is to provide a microactuator for an implantable hearing aid which is simple.

Yet another object of the present invention is to provide a microactuator for an implantable hearing aid which is durable.

Yet another object of the present invention is to provide a microactuator for an implantable hearing aid that is cost effective.

Yet another object of the present invention is to provide a microactuator for an implantable hearing aid easy and economical to manufacture.

An object of the present invention is to provide an implantable microphone having acoustic impedance characteristics which closely match the acoustic impedance of tissue surrounding the implanted microphone.

Another object of the present invention is to provide a rugged implantable microphone capable of surviving external blows or high pressure.

Yet another object of the present invention is to provide a microphone for an implantable hearing aid which is simple.

Yet another object of the present invention is to provide a microphone for an implantable hearing aid that is cost effective.

Yet another object of the present invention is to provide a microphone for an implantable hearing aid that is easy and economical to manufacture.

Briefly, the present invention is a hearing aid which includes an implantable microphone, signal-processing amplifier, battery, and microactuator. The microphone generates an electric signal in response to impingement of sound waves upon the subject. That signal is received, amplified and processed by the signal-processing, battery-powered amplifier before being re-transmitted to the microactuator. The microactuator is adapted for implantation in the subject in a location from which its transducer may mechanically create vibrations in the perilymph within a subject's inner ear. The transducer receives the processed electric signal from the signal-processing amplifier, and in response thereto mechanically generates vibrations in the perilymph. In generating the vibrations in response to the application of a sinusoidal electric signal at a frequency of 1000 Hz, the transducer displaces at least $1.0\times10^{-4}$ microliters of the perilymph fluid for an electrical power input to the microactuator 32 of approximately 25 microwatts.

The transducer to be used in the microactuator is preferably a thin circular disk, 1 to 10 mils thick but typically 3 to 4 mils thick, of stress-biased PLZT (also identified as Rainbow ceramics). Such disks exhibit very high deflections and generate very high forces in comparison with other existing piezoelectric materials and/or structures. This material provides a monolithic structure having both a layer of conventional PLZT and a compositionally reduced layer from which the PLZT oxide has been converted to a conductive cermet material. During operation of the transducer, the PLZT layer expands and contracts laterally upon application of an alternating current ("AC") voltage across the disk. Expansion and contraction of the PLZT layer flexes the disk back-and-forth due to differential expansion between the PLZT layer and the unexpanding cermet layer.

In comparison with conventional laminated unimorphs, the flexing observed for this stress-biased PLZT material is much larger, and the force generated is more than ten times greater. Furthermore, disks of stress-biased PLZT material can be made quite thin, e.g. 100 microns. Excitation of a 100 micron thick disk 1.0 mm in diameter by a ±5.0 volt electrical signal produces deflections having an amplitude required for an implantable hearing aid, e.g. 0.1 micron. The frequency response of these stress-biased PLZT disks for such small deflections is more than adequate for a hearing aid, extending almost to 10 kilo-Hertz ("kHz"). The phase relationship as a function of frequency between the voltage applied across the stress-biased PLZT disk and the disk's deflection is almost linear. The equivalent group delay is approximately 8 microseconds, which is very small even for a 10 kHz signal. Disks of stress-biased PLZT material can be mounted as drumheads in various different ways to small threaded metal tubes, e.g. 1.4 mm in diameter and 2.0 mm long adapted for implantation into a fenestration through the promontory adjacent to the oval window thereby accessing the perilymph in the scala vestibuli of the inner ear. The overall size of the hearing aid's microactuator is therefore very small.

Although these stress-biased PLZT disks can directly create vibrations in the perilymph, it is advantageous to use such disks in conjunction with flexible, very thin diaphragms that can be made out of stainless steel, titanium, aluminum etc. This allows the transducer to be hermetically sealed to avoid all contact between the PLZT material and the perilymph or middle ear structures.

Furthermore, the use of a flexible diaphragm permits hydraulic amplification to increase the displacement of the flexible diaphragm. An increase in the displacement of the flexible diaphragm can be obtained using a simple fluid-filled structure coupled to a larger diameter stress-biased PLZT transducer that is located at the opposite end of the tube from the flexible diaphragm which contacts the perilymph. Such a structure places the stress-biased PLZT transducer in the middle ear cavity which provides more space for the transducer.

Moreover, for either of the two types of microactuator structures described above, the stress-biased PLZT disks may be stacked to increase the total deflection for the same applied voltage with very little increase in the size of the microactuator.

Microactuators of this type consume a minuscule amount of power because the acoustic energy is all delivered directly to the perilymph. Consequently, the battery life of an implanted hearing aid can be five to six years. Furthermore, due to the transducer's small size and its comparatively wide separation from the microphone there is little possibility of positive feedback between the microphone and the microactuator.

The microphone is preferably fabricated from a thin sheet of PVDF that is overcoated with inert metal electrodes. Such sensors, which can be as thin as 8 microns, have a sensitivity comparable to electret microphones, readily operate when implanted subcutaneously, are extremely inert, and are biocompatible. Furthermore, these sensors exhibit a very good acoustic impedance match to body tissues. Such a microphone is readily and unobtrusively implanted in a location on the body which provides natural sound reception, e.g. below the skin of the anterior cartilage of the outer ear or subcutaneously behind the ear. When used in conjunction with the preferred microactuator, there exists a very large separation between the microphone and the microactuator and no electrical or acoustical feedback. Further, acoustical distortion inherent to standard in-the-ear or behind-the-ear hearing aids is eliminated because sound waves are no longer amplified in the external ear canal eliminating distortions due to reflections from the wall.

The preferred PVDF microphone of the present invention possesses many characteristics required for an ideal implantable microphone. However, a fluid-filled, micromachined microphone may be used as an alternative to the preferred PVDF microphone disclosed herein.

These and other features, objects and advantages will be understood or apparent to those of ordinary skill in the art from the following detailed description of the preferred embodiment as illustrated in the various drawing figures.

BRIEF DESCRIPTION OF THE DRAWINGS

FIG. 2, consisting of FIGS. 2*a*, 2*b* and 2*c*, are plan and side elevational views depicting a microphone in accordance with the present invention having planar leads, including an embodiment having an additional signal shield;

FIG. 3 is a cross-sectional elevational view depicting a first embodiment of a microactuator in accordance with the present invention that preferably includes a stress-biased PLZT disk-shaped transducer;

FIG. 3*a* is a cross-sectional view of a stress-biased PLZT disk-shaped transducer and electrodes taken along the line 3*a*—3*a* of FIG. 3;

DETAILED DESCRIPTION OF THE PREFERRED EMBODIMENT

I The Overall System

Figure 1:
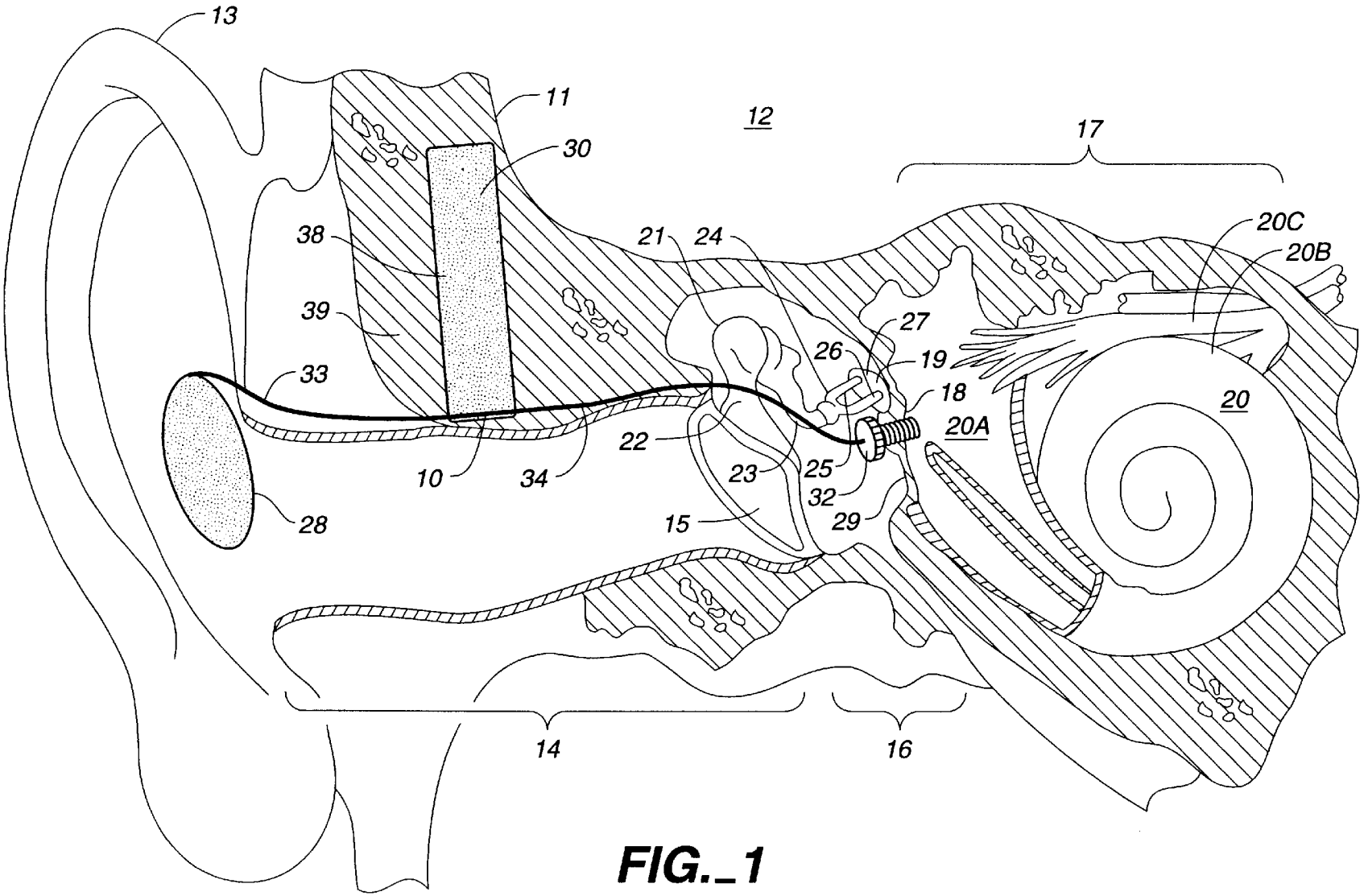
FIG. 1 is a schematic coronal view through a human temporal bone illustrating the external, middle and inner ears, and showing the relative positions of the components of an implantable hearing aid constructed in accordance with the present invention.

FIG. 1 illustrates relative locations of components of an implantable hearing aid 10 in accordance with the present invention after implantation in a temporal bone 11 of a human subject 12. FIG. 1 also depicts an external ear 13 located at one end of an external auditory canal 14. An opposite end of the external auditory canal 14 terminates at an ear drum 15. The ear drum 15 mechanically vibrates in response to sound waves that travel through the external auditory canal 14. The ear drum 15 serves as an anatomic barrier between the external auditory canal 14 and a middle ear cavity 16. The ear drum 15 amplifies sound waves by collecting them in a relatively large area and transmitting them to a much smaller area of an oval-shaped window 19. An inner ear 17 is located in the medial aspects of the temporal bone 11. The inner ear 17 is comprised of otic capsule bone containing the semicircular canals for balance and a cochlea 20 for hearing. A relatively large bone, referred to as the promontory 18, projects from the otic capsule bone inferior to the oval window 19 which overlies a basal coil of the cochlea 20. A round window 29 is located on the opposite side of the promontory 18 from the oval window 19, and overlies a basal end of the scala tympani.

Three mobile bones (malleus, incus and stapes), referred to as an ossicular chain 21, span the middle ear cavity 16 to connect the ear drum 15 with the inner ear 17 at the oval window 19. The ossicular chain 21 conveys mechanical vibrations of the ear drum 15 to the inner ear 17, mechanically de-amplifying the motion by a factor of 2.2 at 1000 Hz. Vibrations of a stapes footplate 27 in the oval window 19 cause vibrations in perilymph fluid 20*a* contained in scala vestibuli of the cochlea 20. These pressure wave "vibrations" travel through the perilymph fluid 20*a* and endolymph fluid of the cochlea 20 to produce a traveling wave of the basilar membrane. Displacement of the basilar membrane bends "cilia" of the receptor cells 20*b*. The shearing effect of the cilia on the receptor cells 20*b* causes depolarization of the receptor cells 20*b*. Depolarization of the receptor cells 20*b* causes auditory signals to travel in a highly organized manner along auditory nerve fibers 20*c*, through the brainstem to eventually signal a temporal lobe of a brain of the subject 12 to perceive the vibrations as "sound."

The ossicular chain 21 is composed of a malleus 22, an incus 23, and a stapes 24. The stapes 24 is shaped like a "stirrup" with arches 25 and 26 and a stapes footplate 27 which covers the oval window 19. The mobile stapes 24 is supported in the oval window 19 by an annular ligament which attaches the stapes footplate 27 to the solid otic capsule margins of the oval window 19.

FIG. 1 also illustrates the three major components of the hearing aid 10, a microphone 28, a signal-processing amplifier 30 which includes a battery not separately depicted in FIG. 1, and microactuator 32. Miniature cables or flexible printed circuits 33 and 34 respectively interconnect the signal-processing amplifier 30 with the microactuator 32, and with the microphone 28. The microphone 28 is mounted below the skin in the auricle, or alternatively in the postauricular area of the external ear 13.

The signal-processing amplifier 30 is implanted subcutaneously behind the external ear 13 within a depression 38 surgically sculpted in a mastoid cortical bone 39 of the subject 12. The signal-processing amplifier 30 receives a signal from the microphone 28 via the miniature cable 33, amplifies and conditions that signal, and then re-transmits the processed signal to the microactuator 32 via the miniature cable 34 implanted below the skin in the external auditory canal 14. The signal-processing amplifier 30 processes the signal received from the microphone 28 to optimally match characteristics of the processed signal to the microactuator 32 to obtain the desired auditory response. The signal-processing amplifier 30 may perform signal processing using either digital or analog signal processing, and may employ both nonlinear and highly complex signal processing.

The microactuator 32 transduces the electrical signal received from the signal-processing amplifier 30 into vibrations that either directly or indirectly mechanically vibrate the perilymph fluid 20*a* in the inner ear 17. As described previously, vibrations in the perilymph fluid 20*a* actuate the receptor cells 20*b* to stimulate the auditory nerve fibers 20*c* which signal the brain of the subject 12 to perceive the mechanical vibrations as sound.

FIG. 1 depicts the relative position of the microphone 28, the signal-processing amplifier 30 and the microactuator 32 with respect to the external ear 13. Even though the signal-processing amplifier 30 is implanted subcutaneously, the subject 12 may control the operation of the hearing aid 10 using techniques analogous to those presently employed for controlling the operation of miniaturized external hearing aids. Both the microphone 28 and the microactuator 32 are so minuscule that their implantation requires little or no destruction of the tissue of the subject 12. Of equal importance, the microphone 28 and the signal-processing amplifier 30 do not interfere with the normal conduction of sound through the ear, and thus will not impair hearing when the hearing aid 10 is turned off or not functioning.

II The Microphone 28

The preferred embodiment of the microphone 28, as illustrated in FIG. 2 consists of a very thin sheet 40 of polyvinylidenefluoride ("PVDF") having an area of approximately 0.5 to 2.0 square centimeter ("$cm^2$"). During fabrication, PVDF is stretched to acquire a permanent dipole. After a permanent dipole has been established, stretching of the sheet, due to acoustic vibration of the supporting body, produces electric charges on its surface. This material is identified commercially by a trademark KYNAR® that is registered to AMPS Corporation.

A PVDF microphone 28 is preferred because the material is impervious to moisture, and is extremely thin. The PVDF material, being a fluorinated polymer, is Teflon like, is extremely inert, does not degrade, and is compatible with the human body. It can be contoured to the body for optimum effect and minimal intrusion. Consequently, a microphone 28 made from this material can be unobtrusively implanted subcutaneously in many places in and around the external ear 13. Location of the microphone 28 in the strongest acoustic field, and physically far away (compared to conventional external hearing aids) from the microactuator 32 has substantial advantages. The minuscule amount of power needed by the microactuator 32 to stimulate the perilymph never reaches the microphone 28. Consequently, there is no electrical or acoustic feedback to create undesirable whistling, screeching or other sound distortion.

The shape and size of microphone 28 can be adapted to fit the desired implantation area. Both sides of the sheet of PVDF, which is typically between 8 to 50 microns thick, are overcoated with thin metal electrodes 42*a* and 42*b*. The overlapping area of the metal electrodes 42*a* and 42*b* defines the active transducer. The metal electrodes 42*a* and 42*b* may be fabricated from biocompatible materials such as gold, platinum, titanium etc. that are applied by vacuum deposition, plating, or silk screening. If necessary, the metal electrodes 42*a* and 42*b* may be supported on the PVDF sheet by an underlying thin layer of an adhesive material such as nickel or chromium.

One of the metal electrodes 42*a* may be grounded and the other electrode 42*b* carries the signal. To avoid picking up spurious electromagnetic signals, the transducer should be installed with the grounded side facing outward and the signal side facing inward towards the temporal bone 11. To guard the electrical signal from interference, as illustrated in FIG. 2*c*, the signal electrode 42*b* may be overcoated with a thin insulating layer 44 that electrically insulates the signal electrode 42*b* from a thin electrically conductive shield 43. The metal electrodes 42*a* and 42*b* together with the shield 43 may be extended in planar form to the signal-processing amplifier 30 thereby providing the miniature cable 33. An alternative way to obtain a guarded structure for the signal electrode 43 is to fold the sheet 40 and the metal electrodes 42 in half thereby producing a structure which has two ground plane metal electrodes 42*a* facing outward that enclose the central signal electrode 42*b*.

The PVDF microphone 28 does not require an air enclosure. In fact, proper operation of the preferred microphone 28 requires good contact with the skin of the external ear 13 or skin overlying the mastoid bone. A thin plastic cover of any biocompatible insulating polymeric material may be applied to insulate the miniature cable 33 electrically from the surrounding tissue.

In air, the electric signal produced by a PVDF microphone is somewhat less than the output of an electret microphone of equal area. However, subcutaneous implantation of the PVDF microphone 28 does not reduce the output signal. A microphone 28 having an area of 1.0 $cm^2$ is sufficient to obtain a very good signal. A microphone 28 having only a fraction of that area is usually adequate.

A 1.0 $cm^2$ sized sheet of PVDF exposed to a 2000 Hz tone at 100 dB, depending upon the support stiffness, generates from 6 to 2 millivolts ("mV") PTP into a 1.0 megohm ("MΩ") impedance.

The PVDF microphone 28 provides an excellent acoustic impedance match to the body tissue, such that there is very little acoustic reflection or loss of incident sound waves. In operation, sound incident on the skin is transmitted into vibration to the underlying tissues, and this vibration creates electric charge on the surface of the PVDF sheet which is picked up by the metal electrodes 42. Experiments with the PVDF microphone 28 inserted under the skin of chicken breasts demonstrate very little sound absorption or attenuation. If exposed to the same frequency and sound intensity, the quality and intensity of the electrical signal generated by such a microphone 28 is approximately the same—whether the microphone is positioned on the surface of the skin or immediately below it (subcutaneously).

Since the PVDF microphone 28 is most sensitive to strain in the direction in which the material was initially stretched, to optimize the signal produced by the microphone 28 the orientation of the microphone 28 with respect to the bending of the underlying tissue should be given some consideration. The microphone 28 operates best if the PVDF sheet is taut. Encircling the PVDF sheet with a flexible plastic hoop 41 that is attached to the perimeter of the sheet provides such tension.

The PVDF microphone 28 described here is simple, inexpensive, inert, robust and occupies very little space. However, other microphones, such as fluid filled micromachined microphones as described by Bernstein, 3rd International Workshop on Transducers, Orlando, Fla., May '92, may be used as an alternative for the preferred PVDF microphone 28. For maximum sensitivity, such micromachined microphones require relatively large bias voltages, and they employ fragile diaphragms in the transducer. Consequently, there exists a significant risk of inadvertently damaging such a micromachined microphone. Other microsensors such as accelerometers could, in principle, also be used to sense incident sound. If used as a microphone for the hearing aid 10, to minimize feedback such microsensors should be located at a position in which the pressure wave of the microactuator 32 has a minimum effect on the microsensor.

III The Microactuator 32

FIG. 3 is a cross-sectional elevational view depicting a simple embodiment of the microactuator 32. The microactuator 32 preferably includes a disk-shaped transducer 45 which is attached to an end of a tube 46. The tube 46 is formed with external threads 47 that adapt the tube 46 to be screwed into a fenestration formed through the promontory 18. The tube 46 has a diameter of approximately 1.4 mm. The fenestration can be made by a mechanical surgical drill, or by present surgical laser techniques. The tube 46 may be made out of stainless steel or any other biocompatible metal.

The transducer 45 is preferably fabricated from a thin circular disk of stress-biased lead lanthanum zirconia titanate ("PLZT") material. This material is manufactured by Aura Ceramics and sold under the "Rainbow" product designation. This PLZT unimorph provides a monolithic structure one side of which is a layer 45*a* of conventional PLZT material. The other side of the PLZT unimorph is a compositionally reduced layer formed by chemically reducing the oxides in the native PLZT material to produce a conductive cermet layer 45*b*. The conductive cermet layer 45*b* typically comprises about 30% of the total disk thickness. Removing of the oxide from one side of the unimorph shrinks the conductive cermet layer 45*b* which bends the whole disk and puts the PLZT layer 45*a* under compression. The PLZT layer 45*a* is therefore convex while the conductive cermet layer 45*b* is concave.

As illustrated in FIG. 3*a*, the PLZT layer 45*a* and the conductive cermet layer 45*b* are respectively overcoated with a thin metal electrode 48 and a cermet electrode 49. The electrodes 48 and 49 may be applied to the transducer 45 in various different ways such as plating, evaporation, metal spraying etc. Application of a potential difference across the electrodes 48 and 49 causes the disk to become either more or less bowed, depending upon the polarity of the applied voltage.

The electrodes 48 and 49 are made from biocompatible metals such as gold, titanium or platinum. The stress-biased transducer 45 is soldered to one end of the tube 46 with indium or with an indium alloy using ultrasonic agitation so the PLZT layer 45*a* of transducer 45 faces the perilymph fluid 20*a*. Alternatively, dental glue may also be used for securing the transducer 45 to the end of the tube 46. The PLZT layer 45*a* of the transducer 45 and the surrounding end of the tube 46 are then overcoated with a layer 37 of a biocompatible metal using a suitable method such as metal evaporation. The layer 37 serves as an electrode for the PLZT layer 45*a* and also electrically connects the electrode 48 to the surrounding end of the tube 46. The conductive cermet layer 45*b* of the electrode 48 is slightly recessed at its rim by grinding so the conductive cermet layer 45*b* does not contact the tube 46. A gold or precious metal lead 50, wire bonded or attached with conductive epoxy to the cermet electrode 49 within the tube 46, serves as a return lead for the electrode 48. Another lead 51 is attached to a surface of the tube 46. The leads 50 and 51 are included in the miniature cable 34 which connects the microactuator 32 to signal-processing amplifier 30.

If the microactuator 32 is implanted into a fenestration formed through the promontory 18 of the inner ear 17, the layer 37 covering the electrode 48 of the transducer 45 contacts the perilymph fluid 20*a*. The transducer 45 deflects when a voltage is applied across electrodes 48 and 49 thereby generating fluid vibrations within the perilymph fluid 20*a* at the frequency of the applied voltage. At the frequencies and the voltages needed for the hearing aid 10, the deflections of the transducer 45 are strictly sinusoidal, and the effect of hysteresis in the material is negligible. The PLZT layer 45*a* of the transducer 45 faces the perilymph fluid 20*a*. This material is biocompatible and poses no problem since it is fully oxidized. The conductive cermet layer 45*b* of the transducer 45, which contains heavy metals, is sealed within the tube 46 by a plug 52 of biocompatible elastomer. Therefore, heavy metal compounds present in the conductive cermet layer 45*b* have no direct contact with the subject 12.

For a specified voltage applied across the stress-biased PLZT disk-shaped transducer 45, the deflection is proportional to $a^2/t^2$, where a is the radius of the disk and t is its thickness. The volume of the perilymph fluid 20*a* displaced by the microactuator 32 is therefore proportional to $a^4$, which indicates a very strong dependence on the disk radius a. It is therefore highly advantageous to increase the diameter of the disk-shaped transducer 45 as much as possible. In the embodiment of the microactuator 32 depicted in FIG. 3, the preceding goal is achieved by making the tube 46 as large as possible in diameter, and by minimizing the wall thickness of the tube 46. The joint between the tube 46 and the disk-shaped transducer 45, depicted in FIG. 3, is a clamped rim, which is rather stiff and tends to limit the excursion of the transducer 45. Another deficiency inherent in the microactuator 32 depicted in FIG. 3 is that breakage of the transducer 45 may expose the subject 12 to heavy metallic compounds present in the conductive cermet layer 45*b*.

Figure 4:
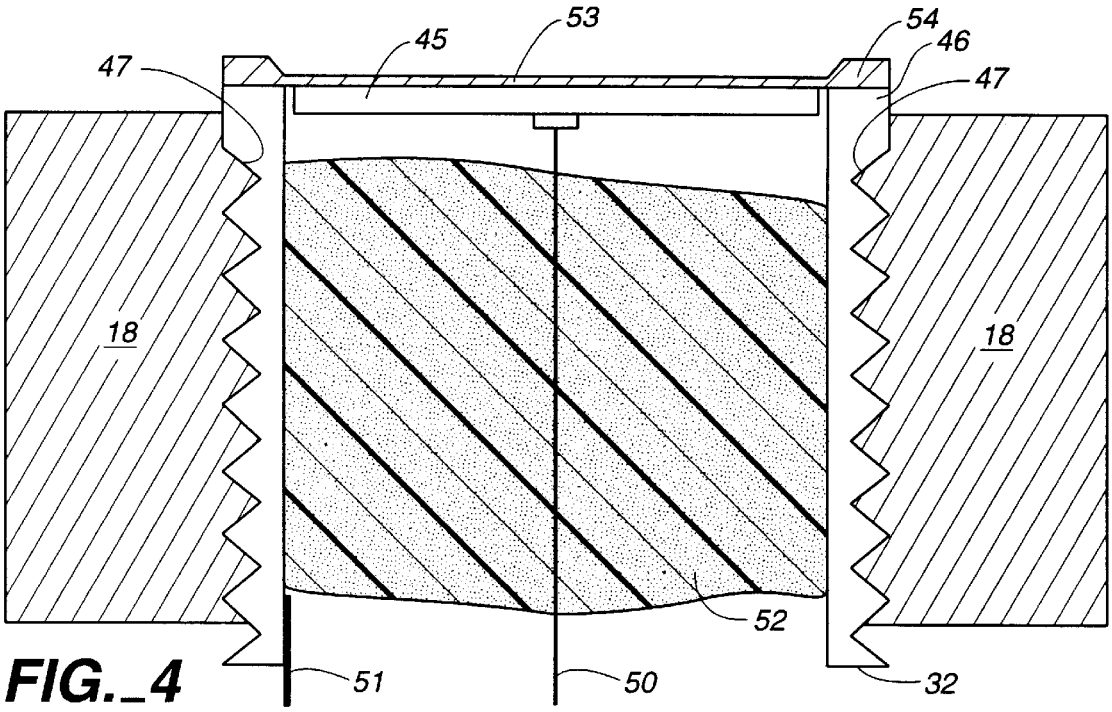
FIG. 4 is a cross-sectional elevational view depicting a preferred embodiment of the microactuator implanted in the promontory of the inner ear in accordance with the present invention.

A preferred embodiment for the microactuator 32 is illustrated in FIG. 4. The embodiment depicted in FIG. 4 differs from the embodiment depicted in FIG. 3 by employing a very thin metallic diaphragm 53 having a rim 54 that is hermetically sealed under slight tension across one end of the threaded tube 46. The diaphragm 53 may be formed with a set of small concentric circular corrugations adjacent to the rim 54 to increase the flexibility of the diaphragm 53. The diaphragm 53 may be sealed to the tube 46 either by laser beam or electron beam welding, or any other suitable sealing technique. The diaphragm 53 may be made out of titanium, stainless steel or aluminum, and may have a thickness of 0.0005 inches (in") (12 micron) at the center of the diaphragm 53. The rim 54 is somewhat thicker, e.g. 0.003 in, which provides adequate thickness for welding the diaphragm 53 to the tube 46. The diaphragm 53 can be readily fabricated using lithographic etching. Again, the diameter of tube 46 should be as large as can be accommodated by the promontory 18 or the stapes 24.

In the embodiment depicted in FIG. 4, the disk-shaped transducer 45 is contained entirely within the tube 46 and is conductively attached to the diaphragm 53 with the conductive cermet layer 45*b* juxtaposed with the diaphragm 53. A very thin layer of conductive epoxy, for example of the type used for silicon die attachment in integrated circuit fabrication, may be used for conductively attaching the transducer 45 to the diaphragm 53. The threaded tube 46 and diaphragm 53 connect to the cermet electrode 49 for the transducer 45. The lead 50 is bonded or attached with conductive epoxy to the electrode 48. The transducer 45 is again sealed within the tube 46 by a plug 52 of biocompatible elastomer.

Figure 4A:
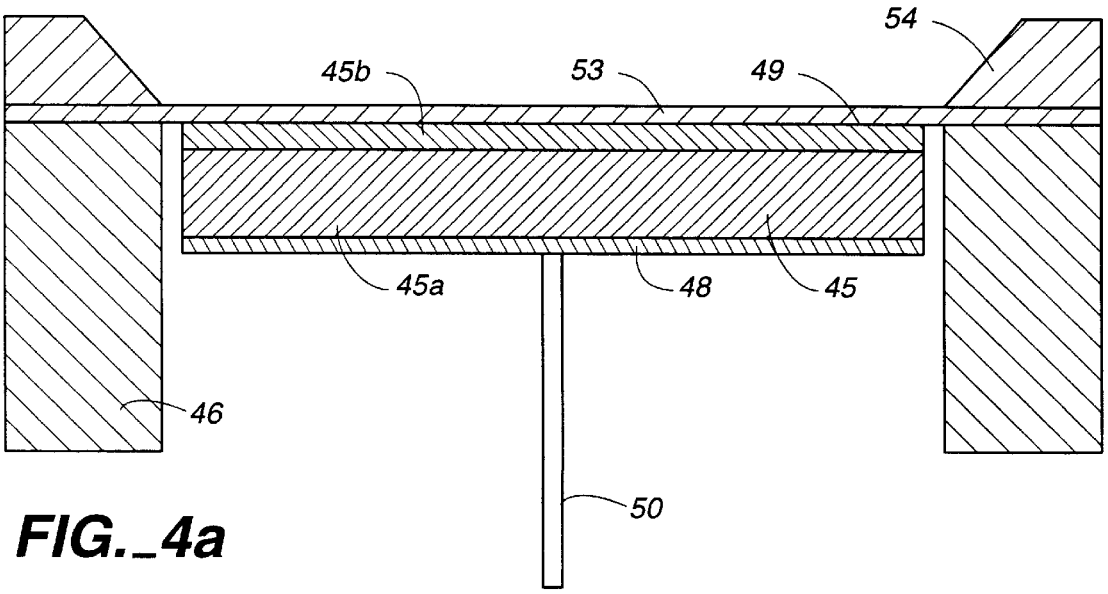
FIG. 4*a* is an enlarged cross-sectional elevational view of the microactuator depicted in FIG. 4 depicting attachment of a disk-shaped transducer to a flexible diaphragm.

In the embodiment depicted in FIGS. 4 and 4*a*, the diameter of the disk-shaped transducer 45 is slightly less than the respective inner diameters of the thin diaphragm 53 and of the tube 46. The diaphragm 53, therefore, serves as a support for the disk-shaped transducer 45, deforms conformally with the transducer 45, and at the same time acts as a flexible hinge. Hence the rim of disk-shaped transducer 45 is now almost simply supported, rather than clamped. For the same applied force, a disk simply support at its rim deflects approximately three times as much as a disk having a clamped rim. Consequently, in the embodiment of the microactuator 32 depicted in FIGS. 4 and 4*a*, the deflection of the transducer 45 and diaphragm 53 is almost three times greater than that of the embodiment depicted in FIG. 3. More significantly, should the disk-shaped transducer 45 break, there can be no contact of the perilymph fluid 20*a* with heavy metals present in the conductive cermet layer 45*b* because the transducer 45 is protected by the metal diaphragm 53.

Figure 13A:
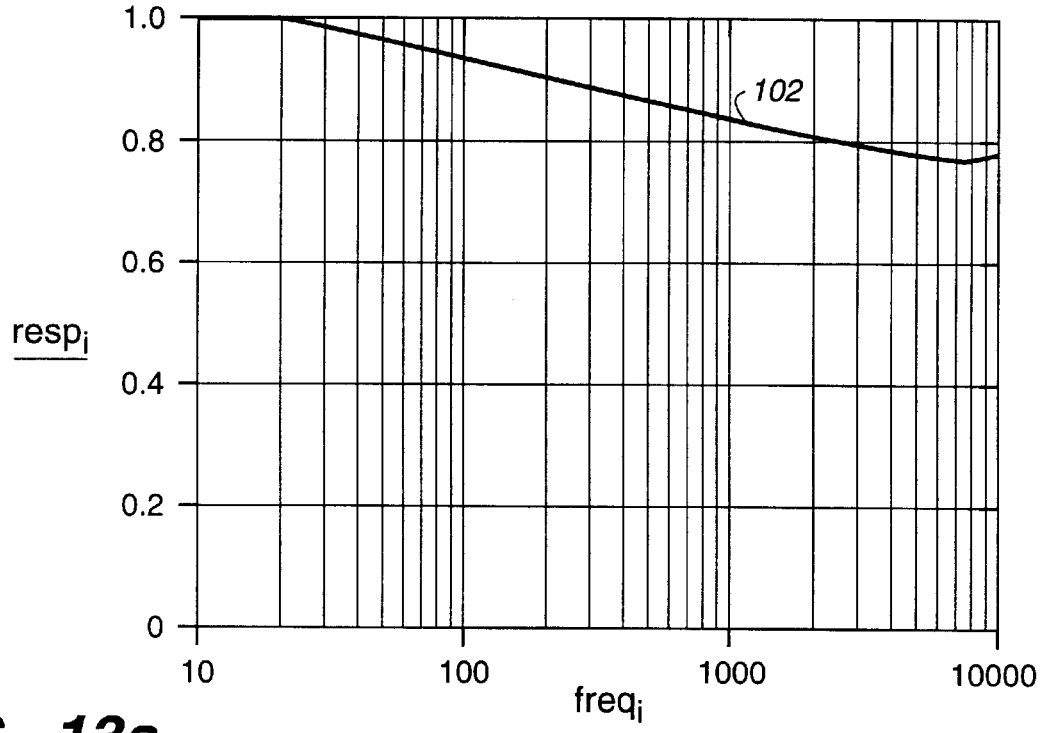
FIG. 13, consisting of FIGS. 13*a* and 13*b*, presents optical displacement measurements respectively of amplitude and phase relationships between a flexible diaphragm of a microactuator in accordance with the present invention for various frequencies of an alternating current voltage applied to the microactuator.
Figure 13B:
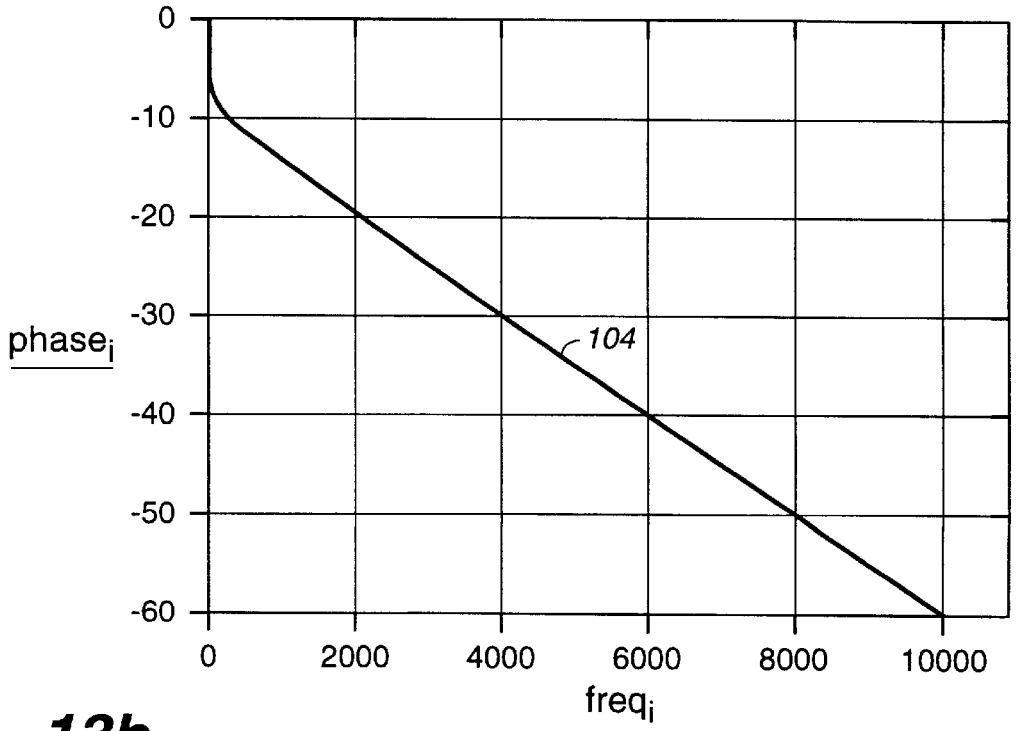

FIG. 12 depicts several different profilometer measurements of deflection of the flexible diaphragm 53 of the microactuator 32 depicted in FIG. 4. A waveform 92 in FIG. 12*a* records a 0.4 micron deflection measured with a profilometer at the center of the diaphragm 53 in response to the application of a ±10 volt 1 Hz square wave signal across a 100 micron thick transducer 45. Waveforms 94 and 96 in FIGS. 12*b* and 12*c* respectively depict corresponding profilometer measurements made near the rim 54 of the diaphragm 53. A waveform 98 in FIG. 12*c* depicts profilometer measurements of deflection of the flexible diaphragm 53 in response to the application of a ±10 volt sine wave signal across the transducer 45 having a frequency between 5 and 10 Hz applied across the transducer 45. Curves 102 and 104 in FIG. 13 present optical displacement measurements respectively of amplitude, FIG. 13*a*, and phase, FIG. 13*b*, relationships between the flexible diaphragm 53 of the microactuator 32 and a sine wave voltage applied across the transducer 45 over a frequency range of 10 to 11,000 Hz. As illustrated in FIG. 13*a*, application to the microactuator 32 of an electrical signal having a constant amplitude produces a substantially constant displacement of the flexible diaphragm 53, i.e. within ±3 db, over a frequency range extending at least from 100 Hz to 10,000 Hz.

The combined thicknesses of the metal diaphragm 53 and the conductive cermet layer 45*b* together now form one side of a unimorph. From the theory of Timoshenko, Journal Optical Society of America, vol. 11, no. 233, 1925, for bimetallic springs, to obtain maximum deflection from the transducer 45 the thickness of the conductive cermet layer 45*b* should be reduced by approximately the thickness of the metal diaphragm 53.

Figure 5:
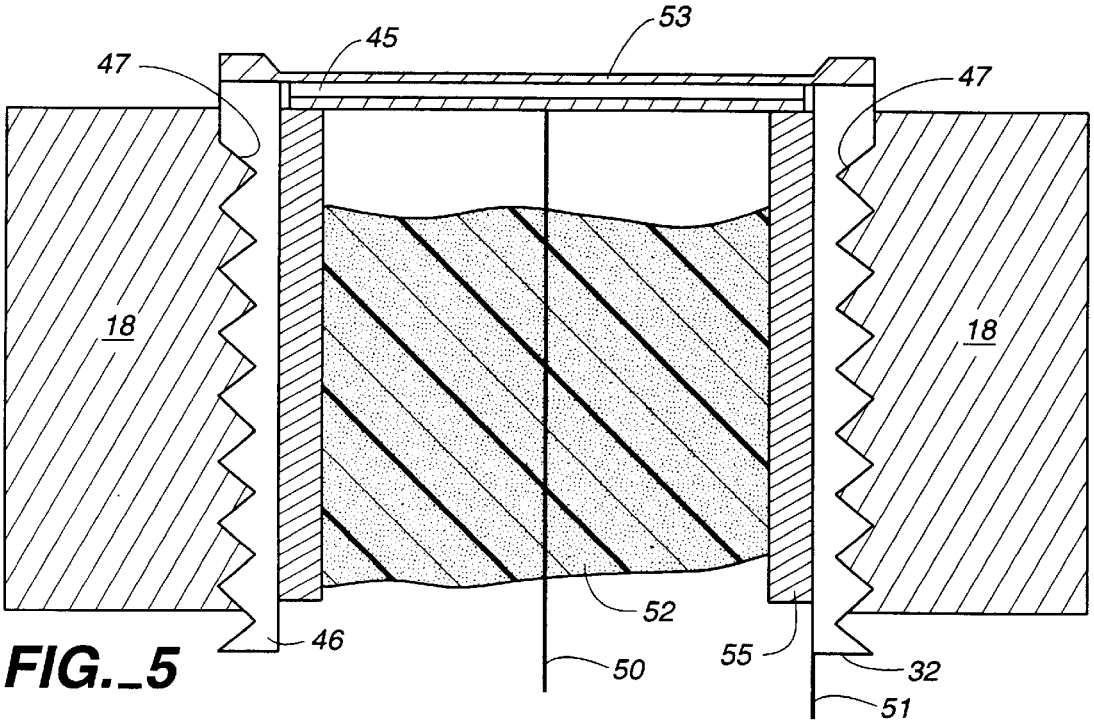
FIG. 5 is a cross-sectional elevational view, similar to FIG. 4, depicting an embodiment of the microactuator in which a sleeve urges the disk-shaped transducer against the flexible diaphragm to adjust tension in the diaphragm.

FIG. 5 depicts an alternative method for securing the transducer 45 within the tube 46. A sleeve 55, either threaded or a split compression sleeve that must be electrically insulated from threaded tube 46, is inserted into the tube 46. The sleeve 55 pushes against the disk-shaped transducer 45 thereby urging it into contact with the diaphragm 53. For best operation the PLZT layer 45*a* should be juxtaposed with the metal diaphragm 53. Preferably the disk-shaped transducer 45 is not glued to the diaphragm 53. Similar to the embodiment depicted in FIGS. 4 and 4*a*, the conductive lead 50 is secured to the cermet electrode 49 and the transducer 45 sealed within the tube 46 by the plug 52. The sleeve 55 urges the PLZT layer 45*a*, that is juxtaposed with the diaphragm 53, into mechanical contact with the diaphragm 53 thereby tensioning the diaphragm 53. Furthermore, the sleeve 55 also provides a fixed mechanical reference for electrically induced deflections of the disk-shaped transducer 45, and may also provide an electrical contact to the conductive cermet layer 45*b*.

Figure 6:
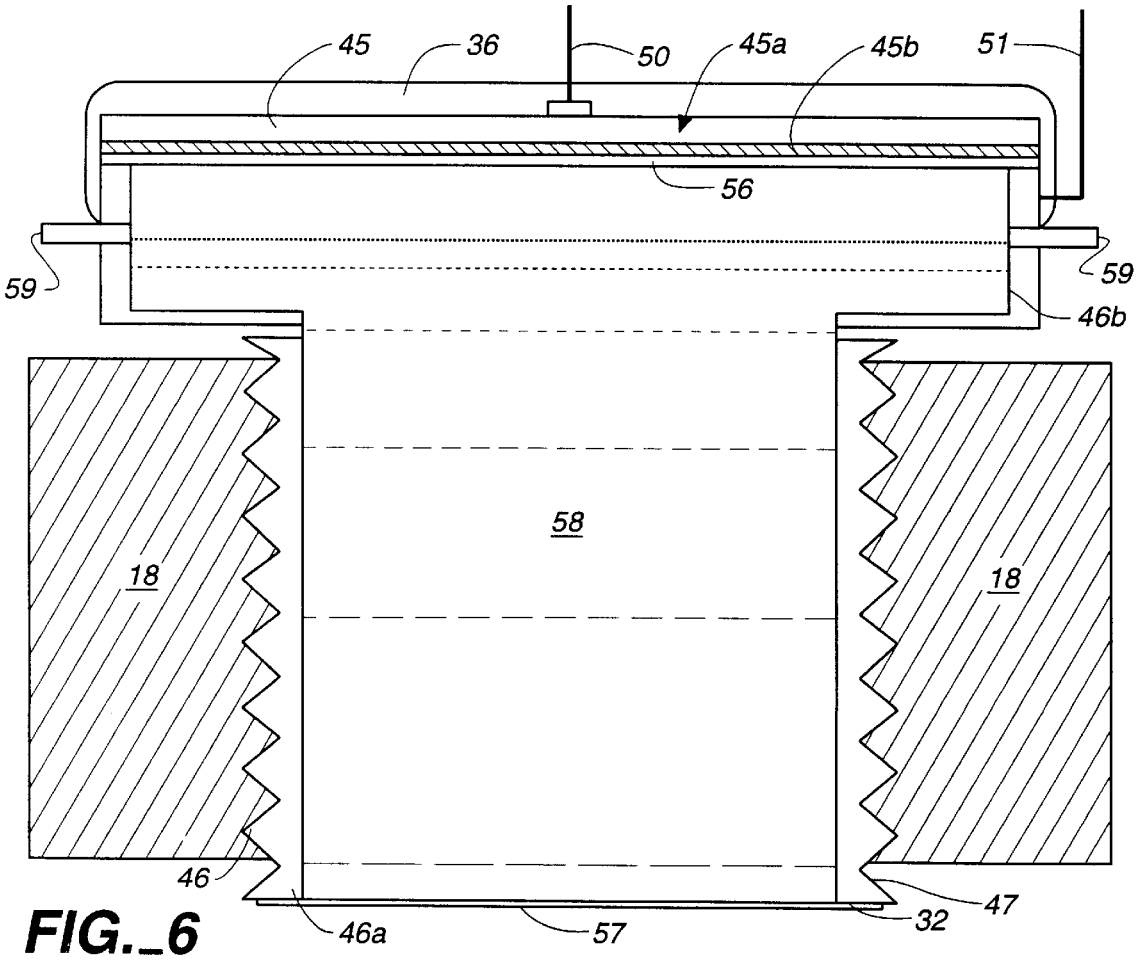
FIG. 6 is a cross-sectional elevational view depicting another alternative embodiment of the microactuator in accordance with the present invention implanted in the promontory of the inner ear, and having a transducer located in the middle ear cavity that is hydraulically coupled to a flexible diaphragm which stimulates the perilymph.

Still another embodiment of the microactuator 32 is illustrated in FIG. 6. In this embodiment a hydraulic amplifier couples the volumetric displacements created by the transducer 45 to a diaphragm 57. The size of the tube 46 which can be implanted in the promontory 18 of the inner ear 17 is limited to about 1.4 mm, which limits the transducer 45 to a maximum diameter of 1.2 mm. However, by locating the PLZT transducer 45 outside the fenestra-tion in the adjacent middle ear cavity 16, its diameter can be almost doubled to about 2.4 mm. For the same applied voltage and disk thickness, doubling the diameter of the transducer 45 effectively increases the volumetric displacement for the same applied voltage by a factor of 16 due both to a four fold increase in area of the transducer 45 and to a fourfold increase in deflection of the transducer 45. Coupling the motion of the enlarged transducer 45 into the inner ear 17 with a hydraulic amplifier provides a dramatic increase in output.

Since acoustic wavelengths even at the highest audio frequencies are all much longer than the dimensions of the microactuator 32, the operation of the hydraulic amplifier can be understood as that of a simple piston. As depicted in FIG. 6, the threaded tube 46 now has a different cross-sectional shape from the tube 46 respectively depicted in FIGS. 3, 4, 4*a* and 5. A smaller end 46*a* of the tube 46 contacts the perilymph fluid 20*a*, while a larger end 46*b* is located in the middle ear cavity 16. Although in principle the transducer 45 may be used to seal the larger end 46*b* of the tube 46, preferably very thin metal diaphragms 56 and 57, similar to the diaphragm 53 described above, seal the tube 46 hermetically at both ends 46*a* and 46*b*. The tube 46 is filled with an incompressible fluid 58 such as silicone oil, saline fluid, etc. The fluid 58 must be degassed and free of bubbles so volumetric displacements of the diaphragm 56 are faithfully transmitted to the diaphragm 57. This is done by evacuating the tube 46 and backfilling it through small stainless steel capillaries 59. The capillaries 59 are then sealed with pulsed laser welding which produces an instantaneous seal without bubbles. Alternatively, small copper capillaries 59 may be used for backfilling and then pinched off.

The disk-shaped transducer 45 is conductively attached to the diaphragm 56 and to the larger end 46*b* of the tube 46. Alternatively, the transducer 45 may be made small enough to rest entirely on diaphragm 56. The conductive cermet layer 45*b* of the transducer 45 is juxtaposed with the metal diaphragm 56. The tube 46 and cermet electrode 49 are preferably grounded. The PLZT layer 45*a* is coated with gold or any other suitable biocompatible material, and the lead 50 attached either through wire bonding or with conductive epoxy. A thin layer 36 of a conformal coating may be coated onto the larger end 46*b* and the transducer 45 to further encapsulate the transducer 45. The microactuator 32 depicted in FIG. 6 transmits volumetric displacements of the transducer 45 completely to diaphragm 57 thereby providing a much larger volumetric displacement than the microactuator 32 depicted in FIG. 3, FIGS. 4 and 4*a*, or FIG. 5 over the small area of the diaphragm 57.

Figure 7:
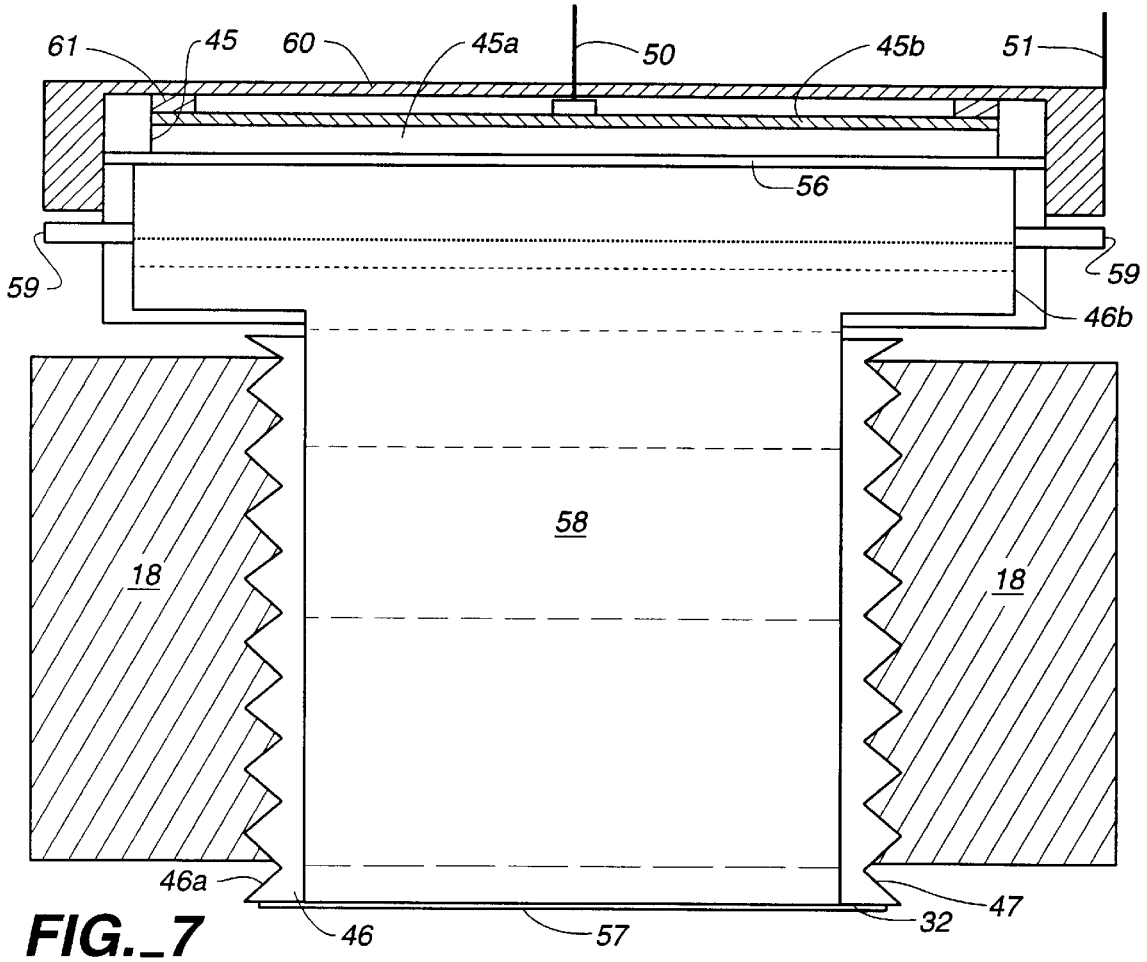
FIG. 7 is a cross-sectional elevational view, similar to FIG. 6, depicting another embodiment of the microactuator having a cap which, for added protection, encloses the disk-shaped transducer and pushes the transducer into contact with a flexible diaphragm.

FIG. 7 depicts an alternative embodiment of the microactuator 32 depicted in FIG. 6. The microactuator 32 illustrated in FIG. 7 uses a metal cap 60 to press an insulating spacer 61 against the stress-biased PLZT disk-shaped transducer 45. Force thus applied by the spacer 61 urges the transducer 45 against the diaphragm 56 thereby tensioning the di aphragm 57. For best results, the PLZT layer 45*a* of the transducer 45 should be juxtaposed with, but not secured to, the diaphragm 56. The cap 60 and the cermet electrode 49 are insulated from each other, and respectively connect to leads 51 and 50. The transducer 45 may rest on the larger end 46*b* of tube 46 if necessary. In the embodiment depicted in FIG. 7, it is undesirable to glue the transducer 45 to the tube 46. Moreover, the cap 60 seals the transducer 45 completely thus minimizing exposure of the subject 12 to the conductive cermet layer 45*b*.

Figure 8A:
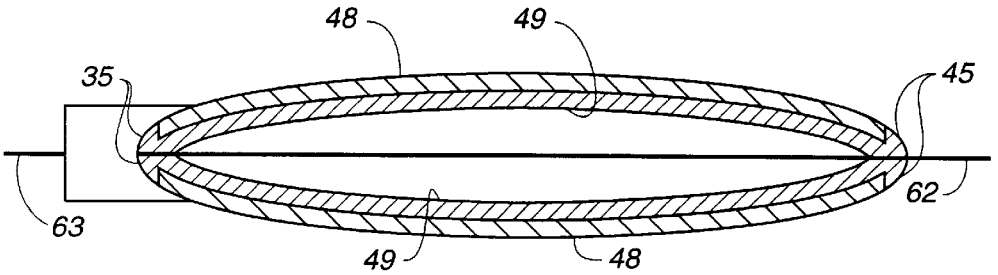
FIG. 8, consisting of FIGS. 8*a* and 8*b*, are cross-sectional elevational views depicting various ways of stacking and connecting stress-biased PLZT transducer disks, in accordance with the present invention, to double the displacement for an identical applied voltage.
Figure 8B:
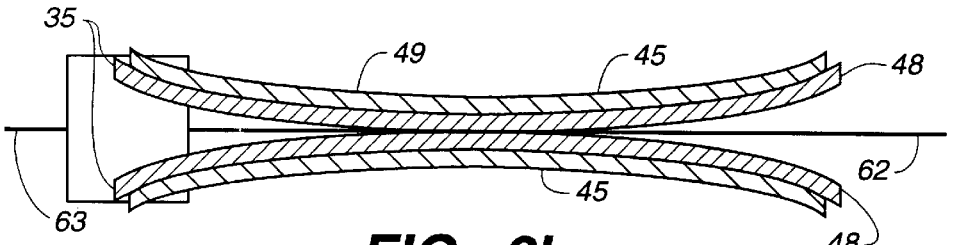

All of the embodiments described thus far have employed a single disk-shaped transducer 45. Since the disk-shaped transducer 45 is stress-biased, curved, and very thin, two disk-shaped transducers 45 can be advantageously arranged to double the amount of excursion for a specified applied voltage without significantly increasing the size of the microactuator 32. Two such disk-shaped transducers 45 can be assembled as illustrated in FIG. 8*a* or FIG. 8*b*. In such configurations of the transducers 45, inner electrodes, respectively the cermet electrodes 49 in FIG. 8*a* and the PLZT electrodes 48 in FIG. 8*b*, are connected together with a lead 62. Similarly, outer electrodes, respectively the PLZT electrodes 48 in FIG. 8*a* and the cermet electrodes 49 in FIG. 8*b*, are also connected together with a lead 63. Applying a specified voltage across leads 62 and 63 now doubles the excursion of the pair of disk-shaped transducer 45 in comparison with the excursion of a single disk-shaped transducer 45 receiving the same voltage. If used in the configurations depicted in FIGS. 8*a* and 8*b*, rims 35 of the disk-shaped transducers 45 are preferably lapped flat to increase the load surface and to avoid breakage. The rims 35 of the disk-shaped transducers 45 of FIG. 8*a* may be glued together to improve stability. Generally the arrangement depicted in FIG. 8*a* is to be preferred. In principle, it is possible to arrange stacks having more than 2 disk-shaped transducers 45.

Figure 9A:
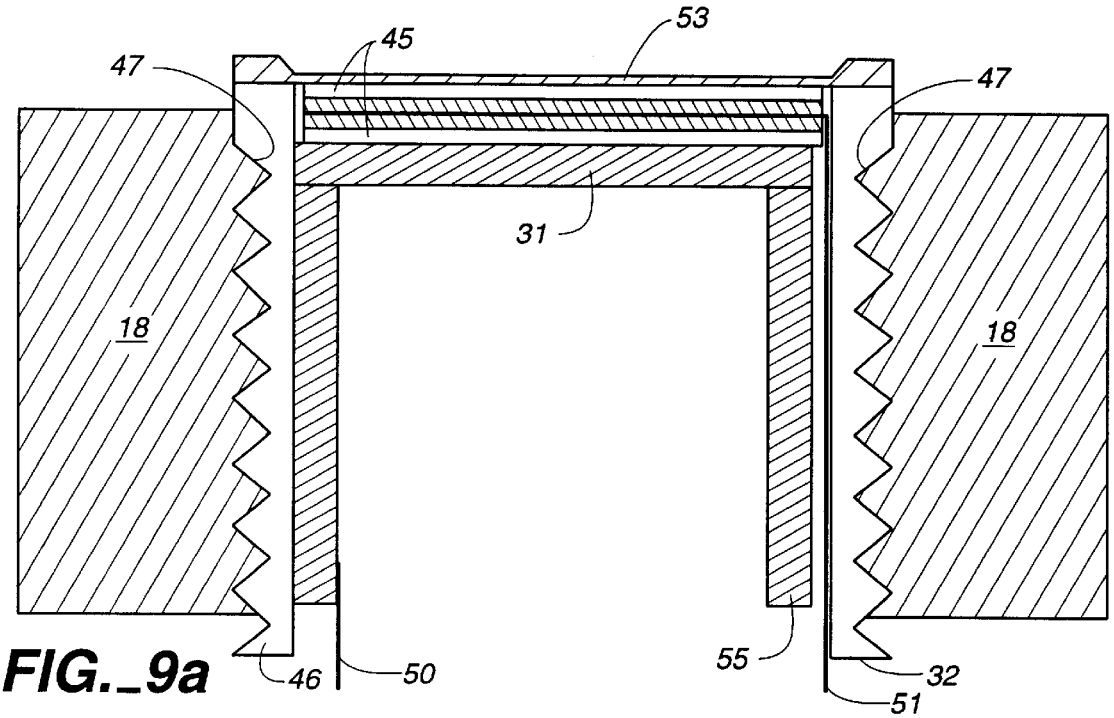
FIG. 9*a* is a cross-sectional elevational view depicting the microactuator illustrated in FIG. 5 incorporating a pair of stacked transducer disks.
Figure 9B:
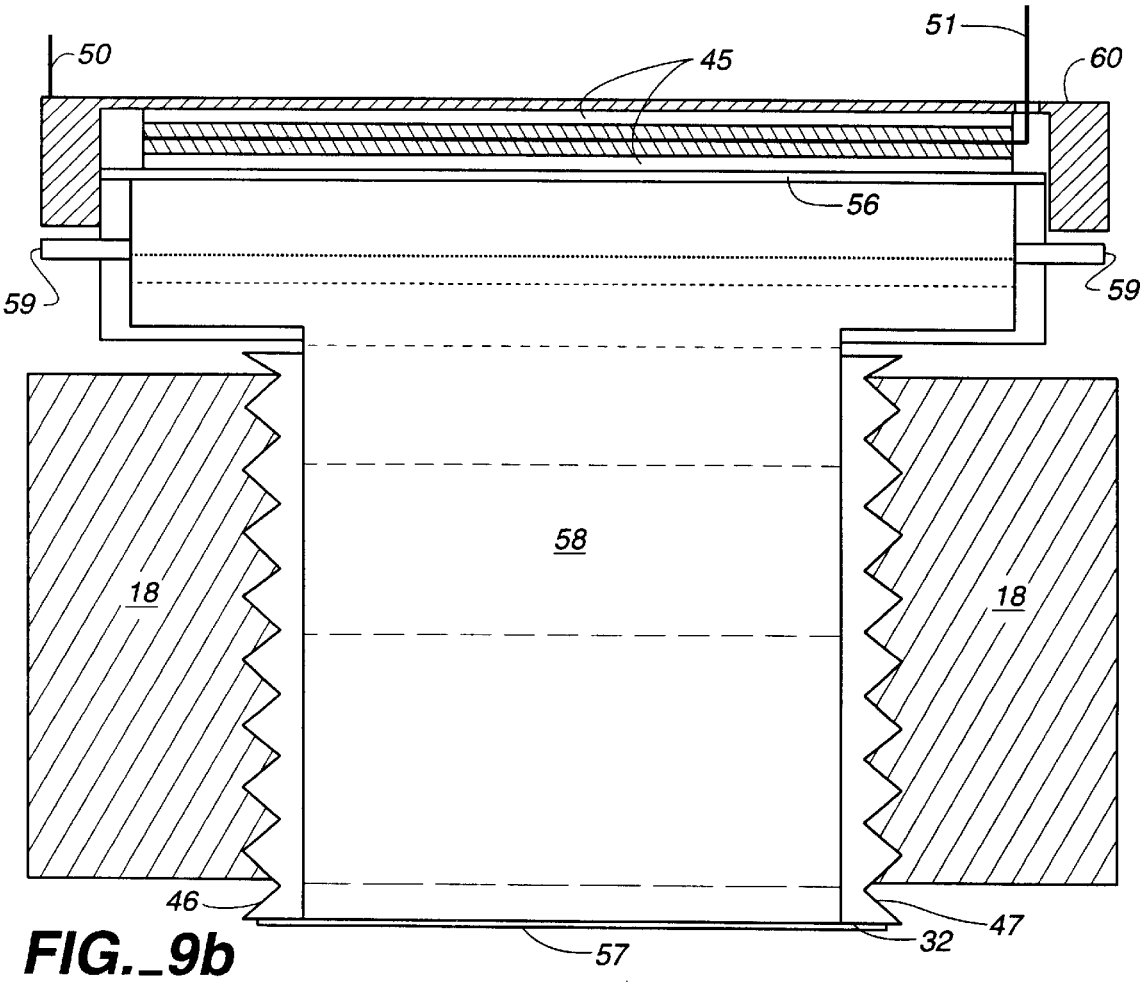
FIG. 9*b* is a cross-sectional elevational view depicting the microactuator illustrated in FIG. 7 incorporating a pair of stacked transducer disks.

The stacked arrangement for the transducers 45 can be used in the embodiments depicted in FIGS. 5 and 7 as respectively depicted in FIGS. 9*a* and 9*b*. The disk-shaped transducer 45 are preferably arranged as in FIG. 8*a*, and are urged against the diaphragm 53 or the diaphragm 56 respectively by a sleeve 55 having a closed end 31 juxtaposed with the stacked transducers 45, or by the cap 60. Note that the closed end 31 of the sleeve 55 must contact the middle of the stacked disk-shaped transducers 45 to obtain the full advantage of the doubling arrangement. The sleeve 55 need no longer be insulated from the tube 46. Thereby, together with the diaphragm 53, the sleeve 55 provides an electrical contact for the outer lead 63 or 50. Similarly, the spacer 61 illustrated in FIG. 7 is omitted from the embodiment depicted in FIG. 9*b*, and the cap 60 together with the tube 46 provide electrical contacts for the outer lead 63 or 50. In the embodiments depicted in FIGS. 9*a* and 9*b*, the lead 51 connects to the inner lead 62 of the stacked transducers 45.

The preceding embodiments have all envisioned the microactuator 32 implanted into a fenestration formed through the promontory 18 of the inner ear 17 opposite the scala vestibuli. By using intermediate structures, the microactuator 32 may also be located and attached in a manner depicted in FIGS. 10, 11, 12 and 13 of the Lesinski et al. patent application. Intermediate structures consisting of small barbed hooks, pins, screws etc. may be relatively easily attached to or formed on an exterior surface of the metal diaphragm 53 or 57, and/or the tube 46. Coupled by such an intermediate structure, a diaphragm 53 or 57 can push and pull a bone in the ossicular chain 21, the ear drum 15, the oval window 19, as described in the Lesinski et al. patent application, or the round window 29. Again, the phase of the driving signal must be compatible with the phase of the normally functioning vibrations of the ossicular chain 21.

Figure 10A:
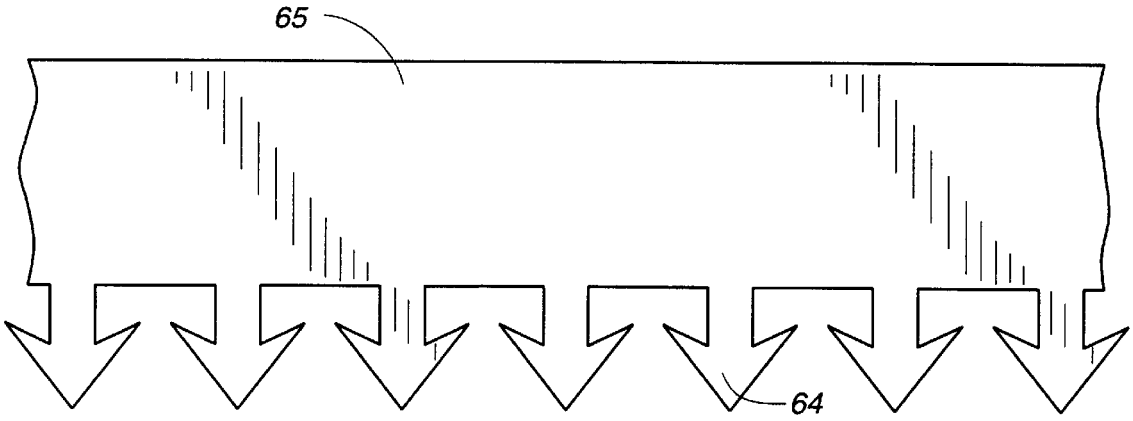
FIG. 10, consisting of FIGS. 10*a* and 10*b*. are plan views depicting micromachined barbs and their attachment around a microactuator for securing the microactuator to tissue.
Figure 10B:
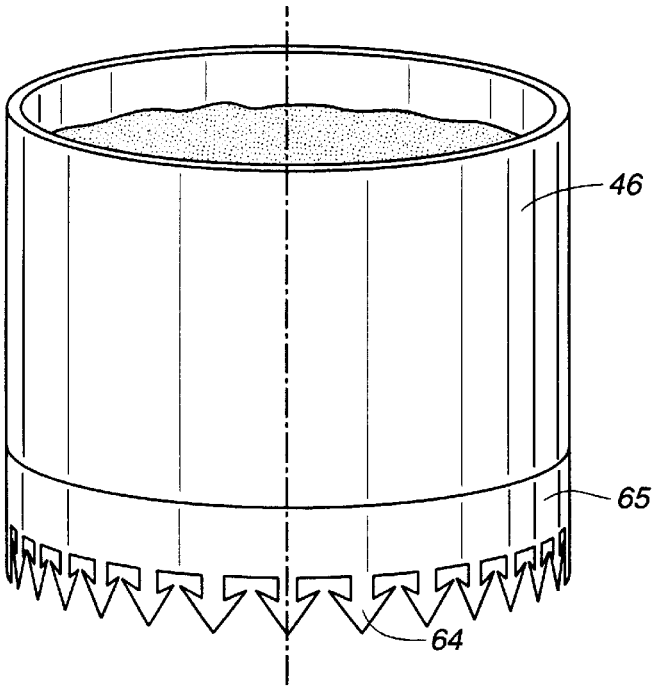

Microfabricated stainless steel foils with barbs 64 a few mils long made from 1 or 2 mil thick foil, may be used to attach the transducer in a Velcro-like manner to various structures of the middle ear cavity 16. Stainless steel sheet 65, 1 to 3 mils thick, is etched along its border, as depicted in FIG. 10*a*, to form a pattern of numerous, lithographically defined barbs 64 a few mils wide and 4 to 8 mils long. The sheet 65 is then wrapped around and secured to the tube 46, as depicted in FIG. 10*b*, with the barbs 64 protruding away from the tube 46. When pressed against tissue, the barbs 64 attach the sheet 65 together with the tube 46 to the tissue. The strength of attachment is determined by the length and size of the barbs 64. The length of the barbs 64 is preferably selected so the microactuator 32 can be removed with minimal damage to the tissue.

A larger diameter microactuator 32 in accordance with the present invention, approximately 8–10 mm in diameter, may be implanted into the external auditory canal 14 in a subject 12 having a damaged ear drum 15. Such a microactuator 32 must include an external protective membrane to seal the microactuator 32 within the external auditory canal 14. The larger diameter transducer 45 of such a microactuator 32 compensates for the larger displacement needed at the ear drum 15, while the external protective membrane, which seals the microactuator 32 within the external auditory canal 14, permits activities such as playing contact sports, swimming, showering, etc.

IV Signal Procehsing Electronics

The microactuator 32 is useful as a hearing aid 10 only if it generates sufficiently large vibrations in the perilymph fluid 20*a* in response to low voltage signals and with very low power dissipation thus permitting the microactuator 32 to be powered for 5 to 6 years by an implantable battery. The disk-shaped transducer 45 responds electrically as a capacitor. Consequently, power dissipation in the transducer 45 is due to charging and discharging the capacitance. Therefore, power dissipation increases with increasig frequency. The dielectric constant of stress-biased PLZT is about 1700. Therefore the capacitance of a stress-biased PLZT disk 1.2 mm in diameter and 100 microns thick is about 240 pico- Farads ("pF"). Such a transducer supported at its rim produces approximately a 0.2 micron PTP displacement for a voltage change of 10 V (or ±5 V). Such a displacement in the perilymph fluid 20*a*, which for a 1,000 Hz sinusoidal voltage s upplied to the transducer 45 requires a 2.4 microampere current, corresponds to a sound level approaching 100 dB. Thus, the transducer 45 in accordance with the present invention, in response to the application of a sinusoidal electric signal at a frequency of 1000 Hz, displaces at least $1.0\times10^4$ microliters of the perilymph fluid 20*a* for an electrical power input to the microactuator 32 of approximately 25 microwatts, i.e. less than 50 microwatts.

Assuming that a more typic al sound level required for the hearing aid 10 is 70 dB, which requires a disk excursion of only 1/30, at 1000 Hz the transducer 45 draws approximately 80 nanoamps. Hence, even if the hearing aid 10 were used continuously, the power consumed by the transducer 45 is virtually negligible. Consequently, all of the embodiments described above for the microactuator 32 are practical and can be used free of concern about overall power consumption by the transducer 45. The power consumed by the hearing aid 10 is mainly that of the signal-processing amplifier 30.

Figure 11:
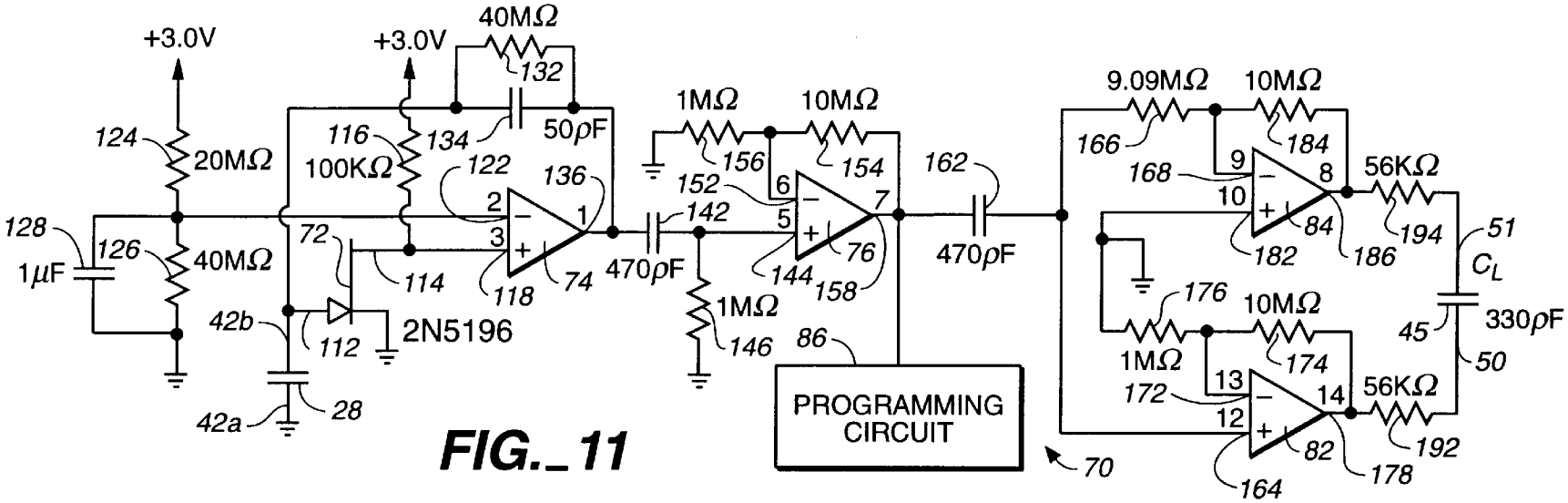
FIG. 11 is a schematic diagram depicting a low-power amplifier having a total current drain of 20 microamperes suitable for driving the microactuator with a signal generated by a microphone.
Figure 12D:
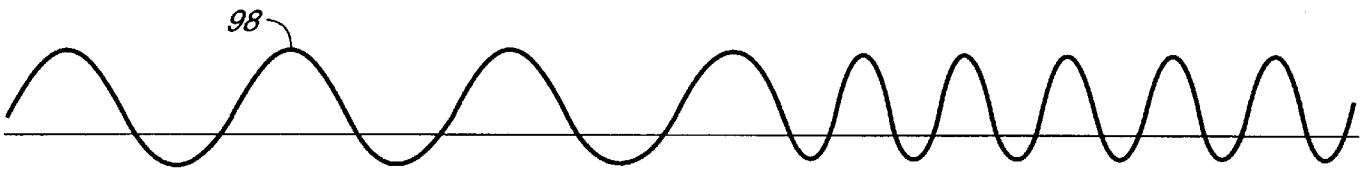
FIG. 12, consisting of FIGS. 12*a*, 12*b*, 12*c* and 12*d*, presents profilometer measurements of deflection of a flexible diaphragm of a microactuator in accordance with the present invention.
Figure 12A:
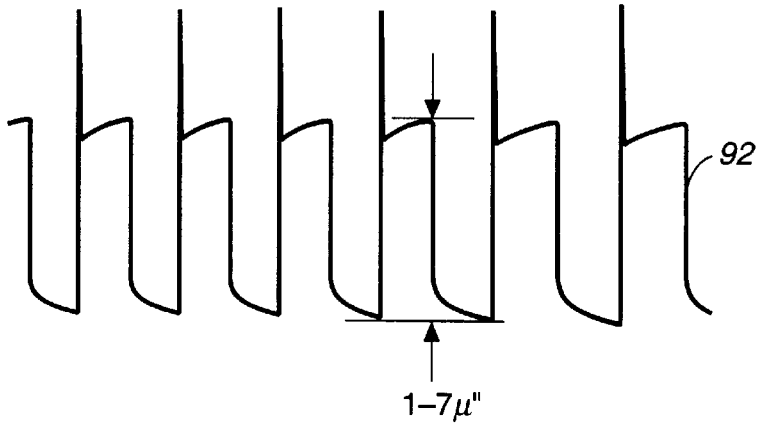
Figure 12B:
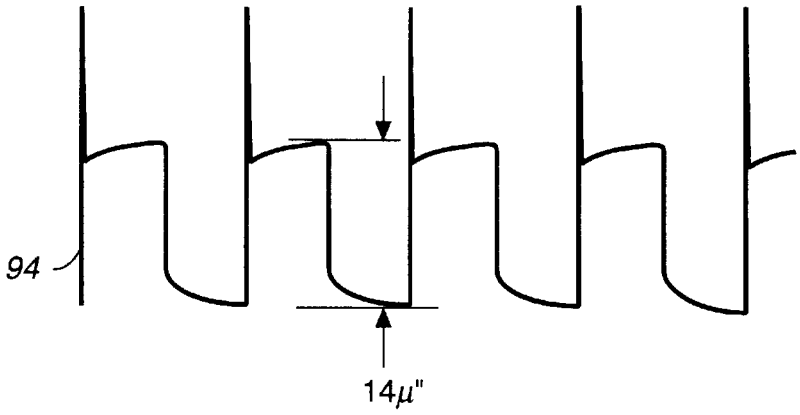
Figure 12C:
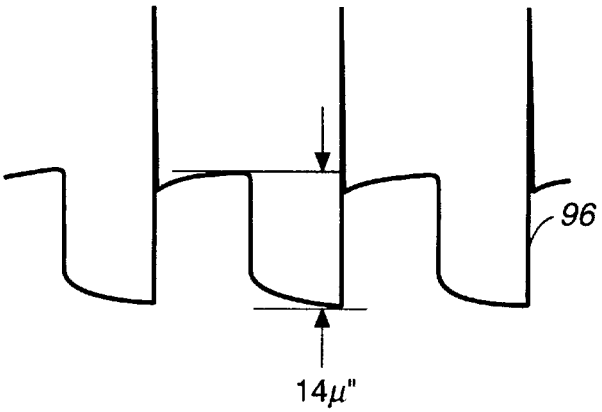

FIG. 11 depicts an amplifier circuit, referred to by the general reference character 70, adapted for driving any of the disclosed embodiments of the microactuator 32. The amplifier 70 includes a low-noise 2N5196 JFET 72 which has a gate 112 that is coupled to the electrode 42*b* to receive the signal produced by the microphone 28. A drain 114 of the JFET 72 is coupled through a 100 KΩ resistor 116 to a +3.0 V supply voltage from a battery not depicted in any of the FIGs. The drain 114 of the JFET 72 is also coupled to a non-inverting input 118 of a Max 491CPD micropower intermediate stage operational amplifier 74 included in the amplifier 70. An inverting input 122 of the operational amplifier 74 is coupled to common terminals of a series connected 20 MΩ resistor 124 and 40 MΩ resistor 126. Coupling of another terminal of the resistor 124 to the ±3.0 V battery supply voltage and another terminal of the resistor 126 to circuit ground provides the inverting input 122 of the operational amplifier 74 with a bias voltage. A 1 μF capacitor 128 is connected in parallel with the resistor 126. A parallel connected 40 MΩ resistor 132 and 50 pF capacitor 134 are connected between an output 136 of the operational amplifier 74 and the gate 112 of the JFET 72. The resistor 132 and the capacitor 134 cause the combined JFET 72 and operational amplifier 74 to operate as a charge-sensitive input stage for the amplifier 70.

A 470 pF capacitor 142 couples an output signal from the output 136 of the operational amplifier 74 to a non-inverting input 144 of a second Max 491CPD micropower operational amplifier 76. A 1 MΩ resistor 146 connects the non-inverting input 144 to circuit ground. An inverting input 152 of the operational amplifier 76 is coupled to common terminals of a series connected 10 MΩ resistor 154 and 1 MΩ resistor 156. Coupling of another terminal of the resistor 154 to an output 158 of the operational amplifier 76 and another terminal of the resistor 156 to circuit ground establishes a fixed gain for the operational amplifier 76.

A 470 pF capacitor 162 couples an output signal from the output 158 of the operational amplifier 76 in parallel both to a non-inverting input 164 of a third Max 491CPD micropower operational amplifier 82, and through a 9.09 MΩ resistor 166 to an inverting input 168 of a fourth Max 491CPD micropower operational amplifier 84. An inverting input 172 of the operational amplifier 84 is coupled to common terminals of a series connected 10 MΩ resistor 174 and 1 MΩ resistor 176. Coupling of another terminal of the resistor 174 to an output 178 of the operational amplifier 82 and another terminal of the resistor 176 to circuit ground establishes a fixed gain for the operational amplifier 82. Analogously, coupling a non-inverting input 182 of the operational amplifier 84 to circuit ground and disposing a 10 MΩ resistor 184 between the inverting input 168 and an output 186 of the operational amplifier 84 establishes a fixed gain for the operational amplifier 84. 56 KΩ resistors 192 and 194 are respectively coupled between the output 178 of the operational amplifier 82 and the lead 50 of the transducer 45, and between the output 186 of the operational amplifier 84 and the lead 51 of the transducer 45. Powering the amplifier 70 with ±3.0 V batteries permits the output signals from the push-pull output-stage operational amplifiers 82 and 84 to apply an almost 12 V PTP signal across the transducer 45.

As described previously, a typical output signal from a 1.0 $cm^2$ PVDF microphone 28 exposed to a 100 dB sound level is approximately 3.0 mV PTP. Consequently, the gain required for the amplifier 70 to reproduce such a 100 dB sound level in the perilymph fluid 20*a* using microactuator 32 is approximately 4000. The amplifier 70 depicted in FIG. 11 draws approximately 20 uA of current. Therefore, using an implantable battery having a capacity of 1.0 ampere hour ("AH") to power the hearing aid 10 16 hours per day provides an anticipated battery life of more than 5 years.

The circuit depicted in FIG. 11 has no special provisions for signal processing, either in analog or digital form, such as appear to be required for the hearing aid 10. Rather, the amplifier 70 merely demonstrates that adequate battery life is feasible for the signal-processing amplifier 30 needed to power the operation of the microactuator 32. Special signal processing circuits, such as those described by Killion in "The K-Amp Hearing Aid: An Attempt to Present High Fidelity for Persons With Impaired Hearing," American Journal of Audiology, vol. 2, no. 2, July 1993, may be used to process and amplify the signal from the microphone 28 for driving the microactuator 32. Accordingly, frequency amplification characteristics of the signal-processing amplifier 30 can be "customized" to meet the unique requirements of each subject's particular hearing loss.

For programming the operation of the signal-processing amplifier 30, for example setting the amplification, selecting passbands or their degree of emphasis, etc., the signal-processing amplifier 30 preferably uses a scheme similar to that employed in programming a computer modem. That is, a programmable transmitter, not illustrated in any of the FIGs., held close to the microphone 28 produces a predefined sequence of acoustical tones, for example tones analogous to the Dual-Tone Multi-Frequency ("DTMF") signals used for touch-tone telephone dialing. A programming circuit 86 included in the signal-processing amplifier 30, that is depicted in FIG. 11 as receiving an output signal from the output 158 of the operational amplifier 76, recognizes this sequence of tones as a command for programming the operation of the signal-processing amplifier 30. Upon receiving such a command, the programming circuit 86 appropriately modifies signal processing characteristics of the signal-processing amplifier 30. Thus, after implantation an audiologist uses the transmitter to adjust the hearing aid 10 for optimum performance. Similarly, the subject 12 uses a simplified, hand-held, battery operated transmitter to set the hearing aid 10 into a sleep mode, or to adjust the operation of the hearing aid 10 to the prevailing sound environment. Such acoustical tones for programming the hearing aid 10 may be transmitted at higher than audio frequencies, since both the PVDF microphone 28 and the signal-processing amplifier 30 are capable of accepting and processing such signals.

The hearing aid 10 is adaptable for implantation in a subject 12 with either conductive hearing loss or sensorineural hearing impairment. It is particularly advantageous over conventional hearing aids in treating subjects with conductive hearing loss from external or middle ear abnormalities, since the external and middle ear are bypassed with the fully implantable hearing aid 10. In subjects with sensorineural hearing impairment, the hearing aid 10 is advantageous over a conventional hearing aid because the hearing aid 10 does not obstruct the normal conduction of sound to the inner ear, but rather acts as a booster to amplify sound directly into the cochlea.

Figure 14A:
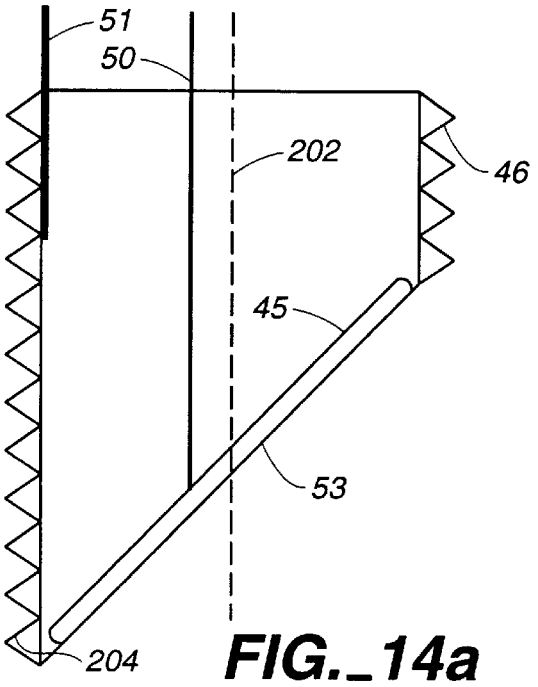
FIG. 14, consisting of FIGS. 14*a* and 14*b*, depicts cross-sectional views of alternative embodiments tube-shaped micro-actuators in which the transducer is disposed at an oblique angle with respect to a longitudinal axis of the microactuator's tube.
Figure 14B:
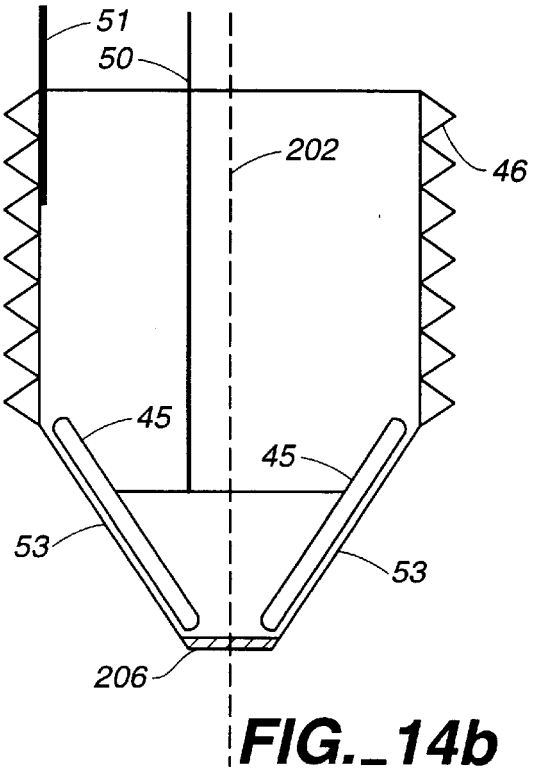

Although the invention has been described in terms of the presently preferred embodiment, it is to be understood that such disclosure is purely illustrative and is not to be interpreted as limiting. For example, while the preferred disk-shaped transducer 45 provides significant advantages when used in conjunction with a tube 46 having a circular cross-sectional shape, transducer plates having other shapes, such as elliptical, oval, and even square or rectangular, are feasible. FIG. 14, consisting of FIGS. 14*a* and 14*b*, depicts disposing an oval-shaped transducer 45 at an oblique angle with respect to a longitudinal axis 202 of the tube 46. The transducer 45 may be disposed at an oblique angle either by having a tapered end 204 on the tube 46 as depicted in FIG. 14*a*, or a pointed end 206 on the tube 46 as depicted in FIG. 14*b*. Disposing the transducer 45 at an oblique angle with respect to the longitudinal axis 202 increases the area of the transducer 45. Increasing the area of the transducer 45 is advantageous because, as set forth previously, the quantity of fluid displaced by the microactuator 32 increases rapidly as transducer area increases.

Figure 15:
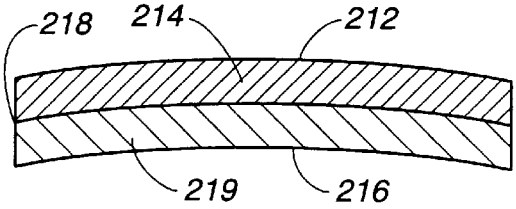
FIG. 15 is a cross-sectional elevational view depicting a laminated metal unimorph which may be substituted for the preferred transducer.

Analogously, while a PLZT monolithic unimorph is preferred for the transducer 45, a microactuator 32 in accordance with the present invention may be fabricated using other types of piezoelectric systems. For example, a microactuator 32 in accordance with the present invention may be fabricated using a metal laminated unimorph 212, depicted in FIG. 15. The laminated unimorph 212 consists of a plate 214 of piezoelectric material, e.g. lead zirconia titanate ("PZT"), onto which is deposited a conductive metallic layer 216. In fabricating the laminated unimorph 212, the piezoelectric plate 214 may be lapped down to a thickness of 1 mil, and then coated with a thin chromium layer 218 onto which is plated a thin nickel layer 219. The thin nickel layer 219 stresses the piezoelectric plate 214 thereby mimicking the stress-bias of the conductive cermet layer 45*b* in the preferred PLZT unimorph transducer 45.

Alternatively, a metal laminated unimorph 212 may be fabricated by applying a thin layer 219 of a memory alloy, such as 5 to 20 microns of Nitinol, Ni—Ti—Cu or Cu—Zn—Al, to the piezoelectric plate 214. After a layer 219 of such material has been applied to the piezoelectric plate 214, heating or cooling the memory alloy establishes a phase in which the memory alloy layer 219 applies compressive or tensile stress to the plate 214. As is apparent to those skilled in the art of memory alloys, hysteresis in a phase transition of a memory alloy maintains that stress upon removal of the heating or cooling. Although the laminated unimorph 212 stressed biased either with the plated nickel layer 219 or with the memory alloy layer 219 appears to be inferior to the preferred stress-biased PLZT unimorph transducer 45, it is possible that the performance of the laminated unimorph 212 might approach that of the preferred unimorph transducer 45.

Figure 16:
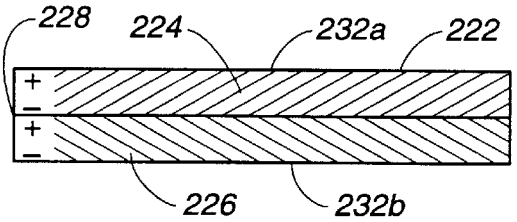
FIG. 16 is a cross-sectional elevational view depicting a bimorph which may be substituted for the preferred transducer.

Similarly, a disk-shaped bimorph 222, illustrated in FIG. 16, might also be substituted for the preferred transducer 45. The bimorph 222 consists of two lapped plates 224 and 226 of a piezoelectric material, such as PZT, 1 mil thick. The plates 224 and 226 are bonded to each other by a layer 228 of electrically conductive material such as a metal. If the piezoelectric plates 224 and 226 of the bimorph 222 are properly poled as indicated by the "+" and "−" symbols in FIG. 16, applying an alternating current voltage from the conductive middle layer 228 to both outer surfaces 232*a* and 232*b* causes the bimorph 222 to alternatively bend back and forth similar to the preferred stress-biased PLZT unimorph transducer 45.

Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A hearing aid adapted for implantation into a subject having both a fluid-filled inner ear, and a middle ear that has an ear drum located distal from the inner ear, said hearing aid comprising:

a microphone adapted for subcutaneous implantation in the subject and for generating an electric signal in response to impingement of sound waves upon the subject;

signal processing means adapted for receiving the electric signal from the microphone, and for processing and re-transmitting a processed electric signal, said signal processing means also being adapted for implantation in the subject;

a battery for supplying electrical power to said signal processing means, said battery also being adapted for implantation in the subject; and a microactuator adapted for implantation in the subject in a location which disposes a transducer included in said microactuator intermediate the fluid filled inner ear and the ear drum, the transducer creating mechanical vibrations in the fluid within the inner ear of the subject in response to receiving the processed electric signal from said signal processing means, the vibrations in the fluid present in the inner ear being proportional to displacing, in response to a sinusoidal processed electric signal at a frequency of 1000 Hz, at least $1.0\times10^{-4}$ microliters of the fluid for an electrical power input to the microactuator of less than 50 microwatts, whereby upon implantation of the microactuator the hearing aid stimulates auditory nerve fibers which stimulation the subject perceives as sound.

2. The hearing aid of claim 1 wherein, in response to application of an electrical signal having a constant amplitude to the microactuator, mechanical vibrations in the fluid within the inner ear created by the transducer have a substantially constant amplitude throughout a frequency range extending from 100 Hz to 10,000 Hz.

3. A hearing aid adapted for implantation into a subject having both a fluid-filled inner ear that is enclosed by a bony otic capsule having a promontory and a middle ear that has an ear drum located distal from the inner ear, said hearing aid comprising:

a microphone adapted for subcutaneous implantation in the subject and for generating an electric signal in response to impingement of sound waves upon the subject;

signal processing means adapted for receiving the electric signal from the microphone, and for processing and re-transmitting a processed electric signal, said signal processing means also being adapted for implantation in the subject;

a battery for supplying electrical power to said signal processing means, said battery also being adapted for implantation in the subject; and a microactuator adapted for implantation in the subject in a location which disposes a transducer included in said microactuator intermediate the fluid filled inner ear and the ear drum, the transducer creating mechanical vibrations in the fluid within the inner ear of the subject, the transducer including a first plate of a piezoelectric material secured to a tube, the piezoelectric material being electrically coupled to the signal processing means for receiving the processed electric signal from said signal processing means, whereby upon implantation of the microactuator the hearing aid stimulates auditory nerve fibers which stimulation the subject perceives as sound.

4. The hearing aid of claim 3 wherein said microphone includes a sheet of PVDF having biocompatible electrodes overcoated onto the sheet.

5. The hearing aid of claim 4 wherein said PVDF sheet is supported by a flexible hoop which encircles said PVDF sheet and applies tension to said PVDF sheet.

6. The hearing aid of claim 3 where in said microphone is a micromachined, fluid-filled hydrophone.

7. The hearing aid of claim 3 wherein said microphone is adapted for implantation at a location distal from said microactuator, thereby reducing acoustic coupling between said microphone and said microactuator.

8. The hearing aid of claim 3 further comprising mounting means adapted for securing said microactuator in a fenestration formed through the promontory whereby implantation of the microactuator will locate the transducer directly in contact with fluid within the inner ear.

9. The hearing aid of claim 8 wherein the mounting means comprises threads formed about an outer surface of the tube, whereby the microactuator is adapted for screwing into the fenestration.

10. The hearing aid of claim 3 wherein an outer surface of the tube and of the plate of piezoelectric material are formed from an electrically conductive material and provide one electrode of the transducer, the electrode being electrically coupled to the signal processing means for receiving the processed electric signal.

11. The hearing aid of claim 3 wherein the first plate is formed from stress-biased PLZT ceramic material which has been processed so one side surface thereof has been compositionally reduced to obtain a material having a cermet composition whereby the first plate constitutes a monolithic unimorph.

12. The hearing aid of claim 3 wherein the first plate is a laminated metal unimorph.

13. The hearing aid of claim 3 wherein the first plate is a bimorph.

14. The hearing aid of claim 3 further comprising mounting means adapted for securing said microactuator in a fenestration formed through the promontory whereby upon implantation of the microactuator will locate the transducer proximate to fluid within the inner ear.

15. A hearing aid adapted for implantation into a subject having both a middle ear cavity in which is located an ossicular chain that consists of a malleus, an incus, and a stapes which terminates in a stages footplate; and a fluid-filled inner ear that is enclosed by a bony otic capsule having a promontory, an oval window to which the stapes footplate attaches, and a round window; said hearing aid comprising:

a microphone adapted for subcutaneous implantation in the subject and for generating an electric signal in response to impingement of sound waves upon the subject;

signal processing means adapted for receiving the electric signal from the microphone, and for processing and re-transmitting a processed electric signal, said signal processing means also being adapted for implantation in the subject;

a battery for supplying electrical power to said signal processing means, said battery also being adapted for implantation in the subject; and a microactuator adapted for implantation in the subject in a location from which a transducer included in said microactuator is adapted to mechanically create vibrations in fluid within the inner ear of the subject, the transducer including a first plate of a piezoelectric material, the first plate of the transducer being secured to a tube, the piezoelectric material being electrically coupled to the signal processing means for receiving the processed electric signal from said signal processing means, wherein the transducer includes a first flexible diaphragm sealed across a first end of the tube, the first plate of the transducer being coupled to the first flexible diaphragm for deflecting the first flexible diaphragm to generate the vibrations in the fluid within the inner ear, whereby upon implantation of the microactuator the hearing aid stimulates auditory nerve fibers which stimulation the subject perceives as sound.

16. The hearing aid of claim 15 further comprising mounting means adapted for securing said microactuator in a fenestration formed through the promontory whereby upon implantation of the microactuator the first flexible diaphragm will be disposed in direct contact with fluid within the inner ear.

17. The hearing aid of claim 16 wherein the mounting means comprises threads formed about an outer surface of the tube, whereby the microactuator is adapted for screwing into the fenestration.

18. The hearing aid of claim 15 wherein the tube and the first flexible diaphragm are formed from electrically conductive materials and provide one electrode for the transducer.

19. The hearing aid of claim 15 wherein the first plate is formed from stress-biased PLZT ceramic material which has been processed so one side surface thereof has been compositionally reduced to obtain a material having a cermet composition whereby the plate constitutes a monolithic unimorph, the side surface of the first plate having cermet composition being juxtaposed with and conductively attached to the first flexible diaphragm; and an electrode, electrically coupled to a side surface of the first plate furthest from the first flexible diaphragm, passes through the tube.

20. The hearing aid of claim 15 wherein the first plate is a laminated metal unimorph that is juxtaposed with the first flexible diaphragm.

21. The hearing aid of claim 15 wherein the first plate is a bimorph that is juxtaposed with the first flexible diaphragm.

22. The hearing aid of claim 15 wherein said microactuator further includes an inner sleeve which fits snugly inside the tube for applying a force to the first plate which urges a side surface of the first plate that is juxtaposed with the first flexible diaphragm into mechanical contact with the first flexible diaphragm thereby tensioning the first flexible diaphragm.

23. The hearing aid of claim 22 wherein the first plate is formed from stress-biased PLZT ceramic material which has been processed so one side surface thereof has been compositionally reduced to obtain a material having a cermet composition whereby the plate constitutes a monolithic unimorph, the side surface having the cermet composition being disposed furthest from the first flexible diaphragm.

24. The hearing aid of claim 22 wherein the first plate is a laminated metal unimorph.

25. The hearing aid of claim 22 wherein the first plate is a bimorph.

26. The hearing aid of claim 22 wherein the transducer further includes a second plate of a piezoelectric material that is juxtaposed with the first plate and disposed between the first plate and the inner sleeve.

27. The hearing aid of claim 26 wherein both the first and second plates are respectively formed from stress-biased PLZT ceramic material which has been processed so one side surface thereof has been compositionally reduced to obtain a material having a cermet composition whereby each of the plates constitutes a monolithic unimorph, the side surface having the cermet composition of the first plate being disposed furthest from the first flexible diaphragm, the side surface of the second plate having the cermet composition being juxtaposed with the side surface of the first plate having the cermet composition, the side surfaces of the plates having the cermet composition being coupled to a common first electrode while opposite side surfaces of the plates that do not have the cermet composition are coupled to a common second electrode.

28. The hearing aid of claim 26 wherein both the first and second plates are respectively laminated metal unimorphs.

29. The hearing aid of claim 26 wherein both the first and second plates are respectively bimorphs.

30. The hearing aid of claim 15 wherein:

a second end of the tube distal from the first end is larger than the first end, said microactuator including a second flexible diaphragm sealed across the second end of the tube thereby hermetically sealing the tube;

the hermetically sealed tube is filled with an incompressible liquid;

the first plate is mechanically coupled to the second flexible diaphragm whereby the first plate indirectly deflects the first flexible diaphragm by directly deflecting the second flexible diaphragm which deflection is coupled by the liquid within the tube from the second flexible diaphragm to the first flexible diaphragm;

said microactuator being adapted for implantation in a fenestration formed through the promontory with:

the first flexible diaphragm being adapted for insertion into the fenestration; and the second, larger end of the tube, the second flexible diaphragm, and the first plate being adapted to be disposed within the middle ear.

31. The hearing aid of claim 30 further comprising mounting means adapted for securing said microactuator in a fenestration formed through the promontory whereby upon implantation of the microactuator the first flexible diaphragm will be disposed in direct contact with fluid within the inner ear.

32. The hearing aid of claim 31 wherein the mounting means comprises threads formed about an outer surface of the tube, whereby the microactuator is adapted for screwing into the fenestration.

33. The hearing aid of claim 30 wherein the first plate is formed from stress-biased PLZT ceramic material which has been processed so one side surface thereof has been compositionally reduced to obtain a material having cermet composition whereby the first plate constitutes a monolithic unimorph, the side surface of the first plate that has cermet composition is juxtaposed with and conductively attached to the second flexible diaphragm.

34. The hearing aid of claim 30 wherein the first plate is a laminated metal unimorph that is juxtaposed with the second flexible diaphragm.

35. The hearing aid of claim 30 wherein the first plate is a bimorph that is juxtaposed with the second flexible diaphragm.

36. The hearing aid of claim 30 wherein said microactuator further includes a cap which encloses the first plate and the second flexible diaphragm, and which encircles the second end of the tube, the cap applying a force to the first plate which urges the first plate into contact with the second flexible diaphragm thereby tensioning both the second flexible diaphragm and the first flexible diaphragm, the cap also providing additional protection against contact between the plate of the microactuator and the subject.

37. The hearing aid of claim 36 wherein the first plate is formed from stress-biased PLZT ceramic material which has been processed so one side surface thereof has been compositionally reduced to obtain a material having a cermet composition whereby the plate constitutes a monolithic unimorph, the side surface of the first plate not having cermet composition being juxtaposed with the second flexible diaphragm.

38. The hearing aid of claim 36 wherein the first plate is a laminated metal unimorph.

39. The hearing aid of claim 36 wherein the first plate is a bimorph.

40. The hearing aid of claim 36 wherein the transducer further includes a second plate of a piezoelectric material disposed between the cap and the first plate.

41. The hearing aid of claim 40 wherein both the first and second plates are respectively formed from stress-biased PLZT ceramic material which has been processed so one side surface thereof has been compositionally reduced to obtain a material having a cermet composition whereby each of the plates constitutes a monolithic unimorph, the side surface having the cermet composition of the first plate being disposed furthest from the second flexible diaphragm, the side surface of the second plate having the cermet composition being juxtaposed with the side surface of the first plate having the cermet composition, the side surfaces of the plates having the cermet composition being coupled to a common first electrode while opposite side surfaces of the plates that do not have the cermet composition are coupled to a common second electrode.

42. The hearing aid of claim 40 wherein both the first and second plates are respectively laminated metal unimorphs.

43. The hearing aid of claim 40 wherein both the first and second plates are respectively bimorphs.

44. The hearing aid of claim 30 further comprising mounting means adapted for securing said microactuator in a fenestration formed through the promontory whereby upon implantation of the microactuator the first flexible diaphragm will be disposed proximate to fluid within the inner ear.

45. The hearing aid of claim 15 wherein the tube has a longitudinal axis, and the first plate is disposed at an oblique angle with respect to the longitudinal axis.

46. The hearing aid of claim 45 wherein the first flexible diaphragm is disposed at an oblique angle with respect to the longitudinal axis.

47. The hearing aid of claim 15 further comprising means adapted for mounting the microactuator within the middle ear so the first flexible diaphragm may contact a stapes footplate located in the middle ear whereby the first flexible diaphragm may indirectly create vibrations in the fluid within the inner ear.

48. The hearing aid of claim 15 further comprising means adapted for mounting the microactuator within the middle ear so the first flexible diaphragm may contact a round window located intermediate the inner ear and the middle ear whereby the first flexible diaphragm may indirectly create vibrations in the fluid within the inner ear.

49. The hearing aid of claim 15 further comprising means adapted for mounting the microactuator within the middle ear so the first flexible diaphragm may contact an ossicular chain located in the middle ear whereby the first flexible diaphragm may indirectly create vibrations in fluid within the inner ear.

50. The hearing aid of claim 15 further comprising mounting means adapted for securing said microactuator in a fenestration formed through the promontory whereby upon implantation of the microactuator the first flexible diaphragm will be disposed proximate to fluid within the inner ear.

51. A hearing aid adapted for implantation into a subject having both a middle ear cavity in which is located an ossicular chain that consists of a malleus, an incus, and a stapes which terminates in a stages footplate; and a fluid-filled inner ear that is enclosed by a bony otic capsule having a promontory, an oval window to which the stapes footplate attaches, and a round window; said hearing aid comprising:

a microphone adapted for subcutaneous implantation in the subject and for generating an electric signal in response to impingement of sound waves upon the subject;

signal processing means adapted for receiving the electric signal from the microphone, and for processing and re-transmitting a processed electric signal, said signal processing means also being adapted for implantation in the subject;

a battery for supplying electrical power to said signal processing means, said battery also being adapted for implantation in the subject; and a microactuator adapted for implantation in the subject in a location from which a transducer included in said microactuator is adapted to mechanically create vibrations in fluid within the inner ear of the subject, the transducer including a first plate of a piezoelectric material, the first plate of the transducer being secured to a tube, the piezoelectric material being electrically coupled to the signal processing means for receiving the processed electric signal from said signal processing means, wherein said signal processing means is programmed to permit adapting signal processing characteristics of said signal processing means to the subject, and whereby upon implantation of the microactuator the hearing aid stimulates auditory nerve fibers which stimulation the subject perceives as sound.

52. A hearing aid adapted for implantation into a subject having both a middle ear cavity in which is located an ossicular chain that consists of a malleus, an incus, and a stapes which terminates in a stapes footplate; and a fluid-filled inner ear that is enclosed by a bony otic capsule having a promontory, an oval window to which the stapes footplate attaches, and a round window; said hearing aid comprising:

a microphone adapted for subcutaneous implantation in the subject and for generating an electric signal in response to impingement of sound waves upon the subject;

signal processing means adapted for receiving the electric signal from the microphone, and for processing and re-transmitting a processed electric signal, said signal processing means also being adapted for implantation in the subject;

a battery for supplying electrical power to said signal processing means, said battery also being adapted for implantation in the subject; and a microactuator adapted for implantation in the subject in a location from which a transducer included in said microactuator is adapted to mechanically create vibrations in fluid within the inner ear of the subject, the transducer including a first plate of a piezoelectric material, the first plate of the transducer being secured to a tube, the piezoelectric material being electrically coupled to the signal processing means for receiving the processed electric signal from said signal processing means, wherein said signal processing means includes a programming circuit adapted for receiving and recognizing as programming commands for establishing signal processing characteristics of said signal processing means a set of tones received by said microphone, and in response thereto the programming circuit appropriately modifies signal processing characteristics of said signal processing means and, whereby upon implantation of the microactuator the hearing aid stimulates auditory nerve fibers which stimulation the subject perceives as sound.

53. A microactuator adapted for receiving an electric signal and in response thereto generating vibrations in a fluid, the microactuator comprising:

a tube having a first end, and a second end distal from and larger than the first end;

a first flexible diaphragm sealed across the first end of said tube and being adapted for contacting the fluid and for generating vibrations in the fluid upon a deflection of said first flexible diaphragm;

a second flexible diaphragm hermetically sealed across the second end of said tube thereby hermetically sealing said tube;

an incompressible liquid filling said hermetically sealed tube; and a first plate of a piezoelectric material that is adapted for receiving the electric signal and is mechanically coupled to said second flexible diaphragm, whereby upon application of an electric signal to said first plate, said first plate indirectly deflects said first flexible diaphragm by directly deflecting said second flexible diaphragm which deflection is coupled by said liquid within the tube from said second flexible diaphragm to said first flexible diaphragm.

54. The microactuator of claim 53 wherein the first plate is formed from stress-biased PLZT ceramic material which has been processed so one side surface thereof has been compositionally reduced to obtain a material having cermet composition whereby the first plate constitutes a monolithic unimorph.

55. The microactuator of claim 54 wherein the side surface of the first plate that has cermet composition is juxtaposed with and conductively attached to the second flexible diaphragm.

56. The microactuator of claim 54 wherein the first plate is disposed with a side surface of the first plate not having cermet composition juxtaposed with the second flexible diaphragm, and wherein said microactuator further includes a cap which encloses the first plate and the second flexible diaphragm and which encircles the second end of the tube, the cap applying a force to the first plate which urges the first plate into contact with the second flexible diaphragm thereby tensioning both the second flexible diaphragm and the first flexible diaphragm.

57. The microactuator of claim 56 further comprising a second plate that is also formed from stress-biased PLZT ceramic material which has been processed so one side surface thereof has been compositionally reduced to obtain a material having a cermet composition, the second plate being disposed between the cap and the first plate with the side surface of the second plate having the cermet composition being juxtaposed with the side surface of the first plate having the cermet composition, the side surfaces of the plates having the cermet composition being coupled to a common first electrode while opposite side surfaces of the plates that do not have the cermet composition are coupled to a common second electrode.

* * * * *